US009208720B2

(12) United States Patent
Tamaki et al.

(10) Patent No.: US 9,208,720 B2
(45) Date of Patent: Dec. 8, 2015

(54) ORGANIC ELECTROLUMINESCENCE DISPLAYING APPARATUS WHICH SUPPRESSES A DEFECTIVE DISPLAY CAUSED BY A LEAK CURRENT AT A TIME WHEN AN EMISSION PERIOD CONTROLLING TRANSISTOR IS OFF

(75) Inventors: Junya Tamaki, Chiba (JP); Nobuhiko Sato, Mobara (JP); Masami Iseki, Mobara (JP); Kouji Ikeda, Chiba (JP); Masahiro Tamura, Mobara (JP); Takeshi Izumida, Mobara (JP); Naoki Tokuda, Mobara (JP)

(73) Assignees: Canon Kabushiki Kaisha, Tokyo (JP); Hitachi Displays, Ltd., Mobara-shi (JP)

( * ) Notice: Subject to any disclaimer, the term of this patent is extended or adjusted under 35 U.S.C. 154(b) by 255 days.

(21) Appl. No.: 13/296,533

(22) Filed: Nov. 15, 2011

(65) Prior Publication Data

US 2012/0127221 A1 May 24, 2012

(30) Foreign Application Priority Data

Nov. 24, 2010 (JP) ..... 2010-261242
Nov. 11, 2011 (JP) ..... 2011-247715

(51) Int. Cl.
*G09G 3/30* (2006.01)
*G09G 5/10* (2006.01)
(Continued)

(52) U.S. Cl.
CPC ..... *G09G 3/3233* (2013.01); *G09G 3/006* (2013.01); *G09G 2300/0819* (2013.01);
(Continued)

(58) Field of Classification Search
CPC ..... G09G 3/30; G09G 3/32; G09G 3/3208; G09G 3/3225; G09G 3/3233; G09G 3/3241; G09G 3/325
USPC ..... 345/76–83
See application file for complete search history.

(56) References Cited

U.S. PATENT DOCUMENTS 6,583,775 B1 6/2003 Sekiya et al.
6,950,081 B2 9/2005 Akimoto et al.
(Continued)

FOREIGN PATENT DOCUMENTS

CN 1506931 A 6/2004
CN 1728218 A 2/2006
(Continued)

OTHER PUBLICATIONS

U.S. Appl. No. 13/286,406, filed Nov. 11, 2011.
(Continued)

*Primary Examiner* — Seokyun Moon
*Assistant Examiner* — Josemarie G Acha, III
(74) *Attorney, Agent, or Firm* — Fitzpatrick, Cella, Harper & Scinto

(57) ABSTRACT

An organic EL displaying apparatus which suppresses a defective display caused by a leak current at a time when an emission period controlling transistor is off is provided. The organic EL displaying apparatus comprises a plurality of pixels each of which includes an organic EL element, a power supply line, a driving transistor and the emission period controlling transistor, a data line, and a control line. In this apparatus, in a certain one of the pixels, a resistance $R_{off}$_ILM between source and drain electrodes of the emission period controlling transistor in an off state of the emission period controlling transistor, and a resistance $R_{bk}$_Dr between source and drain electrodes of the driving transistor in a state that a minimum gradation displaying data voltage has been applied to a gate electrode of the driving transistor satisfy $R_{off}$_ILM≥$R_{bk}$_Dr.

5 Claims, 9 Drawing Sheets

(51) Int. Cl.
*G09G 3/32* (2006.01)
*G09G 3/00* (2006.01)

(52) U.S. Cl.
CPC ..... *G09G 2300/0842* (2013.01); *G09G 2300/0861* (2013.01); *G09G 2320/0233* (2013.01); *G09G 2320/0238* (2013.01); *G09G 2320/0295* (2013.01); *G09G 2330/08* (2013.01); *G09G 2330/10* (2013.01)

(56) References Cited

U.S. PATENT DOCUMENTS

| | | | | |
|---|---|---|---|---|
| 7,259,735 | B2 | 8/2007 | Kasai | |
| 7,834,827 | B2 * | 11/2010 | Miyake et al. | 345/82 |
| 7,999,768 | B2 | 8/2011 | Kim et al. | |
| 7,999,770 | B2 | 8/2011 | Kasai | |
| 8,624,807 | B2 | 1/2014 | Miyake et al. | |
| 8,659,519 | B2 | 2/2014 | Abe et al. | |
| 2003/0067424 | A1 | 4/2003 | Akimoto et al. | |
| 2004/0150595 | A1 * | 8/2004 | Kasai | 345/82 |
| 2006/0022900 | A1 | 2/2006 | Miyake et al. | |
| 2007/0091029 | A1 * | 4/2007 | Uchino et al. | 345/76 |
| 2007/0257867 | A1 | 11/2007 | Kasai | |
| 2007/0257868 | A1 | 11/2007 | Kasai | |
| 2008/0001974 | A1 | 1/2008 | Kim et al. | |
| 2008/0036706 | A1 * | 2/2008 | Kitazawa | 345/76 |
| 2008/0204435 | A1 | 8/2008 | Miyamoto | |
| 2009/0102761 | A1 | 4/2009 | Akimoto et al. | |
| 2009/0135111 | A1 * | 5/2009 | Yamamoto et al. | 345/76 |
| 2010/0053041 | A1 | 3/2010 | Abe et al. | |
| 2010/0253666 | A1 * | 10/2010 | Yamamoto | 345/211 |
| 2011/0057925 | A1 | 3/2011 | Miyake et al. | |
| 2011/0227908 | A1 * | 9/2011 | Choi | 345/215 |

FOREIGN PATENT DOCUMENTS

| | | | |
|---|---|---|---|
| CN | 101097684 | A | 1/2008 |
| CN | 101123065 | A | 2/2008 |
| JP | 2002-149112 | A | 5/2002 |
| JP | 2003-122301 | A | 4/2003 |
| JP | 2003-122304 | A | 4/2003 |
| JP | 2007-241009 | A | 9/2007 |
| TW | 201011719 | A | 3/2010 |

OTHER PUBLICATIONS

U.S. Appl. No. 13/299,940, filed Nov. 18, 2011.
U.S. Appl. No. 13/302,047, filed Nov. 22, 2011.
U.S. Appl. No. 13/296,547, filed Nov. 15, 2011.
Taiwanese Office Action issued in counterpart application No. 100142902 dated Jan. 28, 2014, along with its English-language translation—12 pages.
Chinese Office Action issued in counterpart application No. 201110377025.X dated Dec. 16, 2013, along with its English-language translation—17 pages.
Chinese Office Action issued in counterpart application No. 201110377025.X dated Jul. 17, 2014, along with its English-language translation—17 pages.
Japanese Office Action issued in corresponding application No. 2011-247715 dated Sep. 15, 2015—6 pages with partial English translation.

* cited by examiner

| GRADATION DISPLAYING DATA | PERIOD (C) | PERIOD (D) |
|---|---|---|
| MINIMUM GRADATION DISPLAYING DATA | (1)   | (2)   |
| MAXIMUM GRADATION DISPLAYING DATA | (3)   | (4)   |

ORGANIC ELECTROLUMINESCENCE DISPLAYING APPARATUS WHICH SUPPRESSES A DEFECTIVE DISPLAY CAUSED BY A LEAK CURRENT AT A TIME WHEN AN EMISSION PERIOD CONTROLLING TRANSISTOR IS OFF

BACKGROUND OF THE INVENTION

1. Field of the Invention

The present invention relates to an organic EL (electroluminescence) displaying apparatus.

2. Description of the Related Art

An organic EL displaying apparatus is constituted by arranging pixels each having an organic EL element on a substrate in a matrix form. In each pixel, the organic EL element is connected in series to a transistor for driving the organic EL element (hereinafter, called a driving transistor) and a power supply line for supplying power to the organic EL element. Here, Japanese Patent Application Laid-Open No. 2003-122301 discloses a constitution of achieving a satisfactory moving image displaying characteristic by further providing in series a transistor for controlling an emission period (hereinafter, called an emission period controlling transistor) between the power supply line and the organic EL element.

Further, since the organic EL displaying apparatus is a self-emitting displaying apparatus, there is an advantage capable of securing high contrast as compared with a liquid crystal displaying apparatus. Furthermore, several kinds of organic EL displaying apparatuses constituted so that a user can switch over a high-luminance displaying mode and a low-luminance displaying mode according to a kind of image data have been developed. Incidentally, there is a constitution of achieving a low-luminance display by lowering a peak value of luminance. However, since a current-luminance characteristic of the organic EL element is not linear, a complicated system is necessary to make a gamma characteristic constant between the high-luminance displaying mode and the low-luminance displaying mode. On the other hand, U.S. Pat. No. 6,583,775 discloses a constitution of achieving a low-luminance display by shortening an emission period without changing a peak vale of luminance from that in a high-luminance displaying mode.

However, in case of performing driving to control the emission period as disclosed in Japanese Patent Application Laid-Open No. 2003-122301, there is a case where a defective display occurs by a leak current at a time when an emission period controlling transistor is off, for the following reason.

In the driving to control the emission period, a desired gradation display is achieved by emission luminance of the organic EL element in the emission period. In the organic EL displaying apparatus of a voltage write driving type, a data voltage being gradation displaying data is input as a data signal from a data line to the driving transistor of each pixel. The data voltage to be input as the data signal has a voltage value between a minimum gradation displaying data voltage and a maximum gradation displaying data voltage, thereby performing the gradation display.

Further, an emission period and a non emission period are defined by on and off states of the emission period controlling transistor. When resistance at a time when the emission period controlling transistor is off is not sufficiently large, a leak current flows in the organic EL element even in the non emission period in the driving sequence, whereby the organic EL element emits light. When the emission luminance (also, merely called the luminance hereinafter) by the leak current is larger than the luminance in the emission period at the time of the minimum gradation display, light emission which is larger than the luminance in the emission period at the time of the minimum gradation display is superposed in the non emission period. Thus, there is a problem that a defective display such as a luminance variation, black floating at the time of the minimum gradation display, or the like occurs.

The above problem becomes more conspicuous in the constitution, as disclosed in U.S. Pat. No. 6,583,775, of achieving the low-luminance display by shortening the emission period, for the reason that a proportion of the non emission period in the one frame period becomes long. Thus, in this constitution, since a leak emission amount to be superposed further increases, the contrast deteriorates.

SUMMARY OF THE INVENTION

In consideration of the above-described conventional problem, the present invention aims to provide an organic EL displaying apparatus which suppresses a defective display caused by a leak current at a time when an emission period controlling transistor is off.

To achieve the above object, the present invention is directed to an organic EL displaying apparatus which is characterized by comprising: a plurality of pixels each of which includes an organic EL element, a driving transistor configured to supply a current according to potential of a gate electrode to the organic EL element, and an emission period controlling transistor connected in series to the organic EL element and the driving transistor and configured to control light emission of the organic EL element in response to a control signal; a data line configured to apply a data voltage according to gradation displaying data to the pixels; and a control line configured to supply the control signal to a gate electrode of the emission period controlling transistor, wherein, in a certain one of the pixels, a resistance $R_{off}$_ILM between a source electrode and a drain electrode of the emission period controlling transistor in an off state of the emission period controlling transistor, and a resistance $R_{bk}$_Dr between a source electrode and a drain electrode of the driving transistor in a state that a minimum gradation displaying data voltage has been applied to the gate electrode of the driving transistor satisfy an expression (1) of $R_{off}$_ILM≥$R_{bk}$_Dr.

According to the present invention, the luminance obtained by the leak current at the time when the emission period controlling transistor is off in a non emission period does not become larger than the luminance corresponding to the minimum gradation displaying data in an emission period. Therefore, it is possible to suppress that defective display such as a luminance variation, black floating at the time of the minimum gradation display, or the like occurs.

Further features of the present invention will become apparent from the following description of exemplary embodiments with reference to the attached drawings.

DESCRIPTION OF THE EMBODIMENTS

Figure 1:
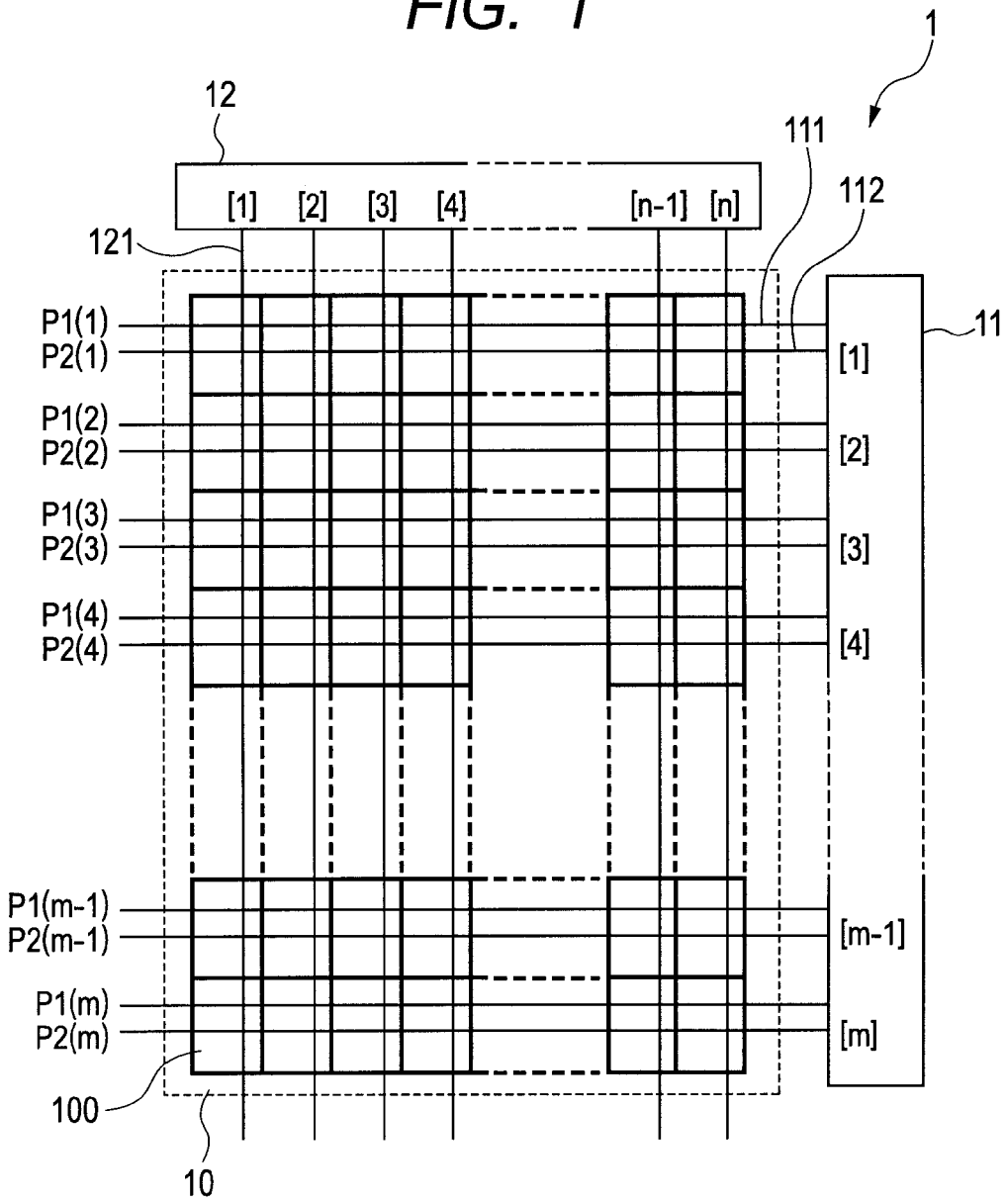
FIG. 1 is a diagram illustrating a constitution of an organic EL displaying apparatus according to a first embodiment.

Hereinafter, organic EL displaying apparatuses according to preferred embodiments of the present invention will be described in detail with reference to the accompanying drawings. Here, it should be noted that scale sizes of the respective drawings are different from the actuals because respective members in the drawings are properly enlarged and reduced to be easily recognized as necessary.

First Embodiment

FIG. 1 is a diagram illustrating a constitution of an organic EL displaying apparatus 1 according to the first embodiment of the present invention. In the present embodiment, the organic EL displaying apparatus 1 has a displaying region 10 in which a plurality of pixels 100 are two-dimensionally arranged in the form of m rows×n columns (m, n are natural numbers). Each of the pixels 100 in the displaying region 10 is a red pixel, a blue pixel or a green pixel, and each pixel has an organic EL element, a driving transistor and an emission period controlling transistor. Here, the driving transistor supplies a current according to potential of the gate electrode to the organic EL element, and the emission period controlling transistor, which is connected between the source electrode or the drain electrode of the driving transistor and the organic EL element, controls light emission of the organic EL element in response to a control signal. Incidentally, the emission period controlling transistor may be connected between a power supply line and the source electrode or the drain electrode of the driving transistor. In other words, the emission period controlling transistor may be disposed at any location on a wiring route if it is possible to interrupt the current flowing in the organic EL element, and the emission period controlling transistor is connected in series to the organic EL element and the driving transistor. In any case, a pixel circuit (see FIG. 2A) is constituted by the organic EL element, the power supply line, the driving transistor, the emission period controlling transistor, and the like.

Further, the organic EL displaying apparatus 1 illustrated in FIG. 1 has data lines 121 each of which is used to supply a data voltage according to gradation displaying data to the pixels 100, and control lines 112 each of which is used to supply the control signal for controlling the light emission of the organic EL element to the gate electrode of the emission period controlling transistor.

Furthermore, the organic EL displaying apparatus 1 illustrated in FIG. 1 has a row controlling circuit 11 for controlling the operation of the pixel circuit, and a column controlling circuit 12 for controlling the data voltage to be supplied to the data line. However, the organic EL displaying apparatus may have a constitution not illustrated in FIG. 1 if the relevant constitution has functions same as those of the row and column controlling circuits.

The control signal is input from a driver IC or the like (not illustrated) to the row controlling circuit 11, and a plurality of control signals P1(1) to P1(*m*) and P2(1) to P2(*m*) for controlling the pixel circuits are output from the respective output terminals of the row controlling circuit 11. Here, the control signal P1 is input to the pixel circuit of each row through a control line 111, and the control signal P2 is input to the pixel circuit of each row through the control line 112. In FIG. 1, the two control lines are connected to each output terminal of the row controlling circuit 11. However, only one control line or three or more control lines may be used according to a constitution of the pixel circuit.

A video signal is input from the driver IC or the like (not illustrated) to the column controlling circuit 12, and a data voltage $V_{data}$ being the gradation displaying data (data signal) according to the video signal is output from each output terminal of the column controlling circuit. The data voltage $V_{data}$ output from the output terminal of the column controlling circuit 12 is input to the pixel circuit of each column through the data line 121, and has the voltage value between the minimum gradation displaying data voltage and the maximum gradation displaying data voltage, thereby performing the gradation display.

Figure 2A:
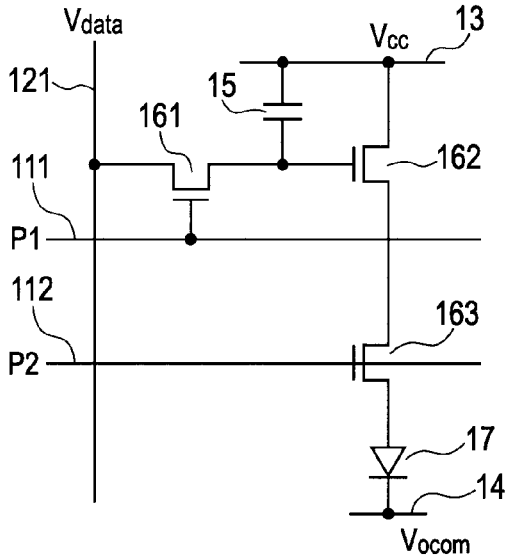
FIGS. 2A and 2B are diagrams indicating a constitution of a pixel circuit of the organic EL displaying apparatus and its driving method, according to the first embodiment.
Figure 2B:
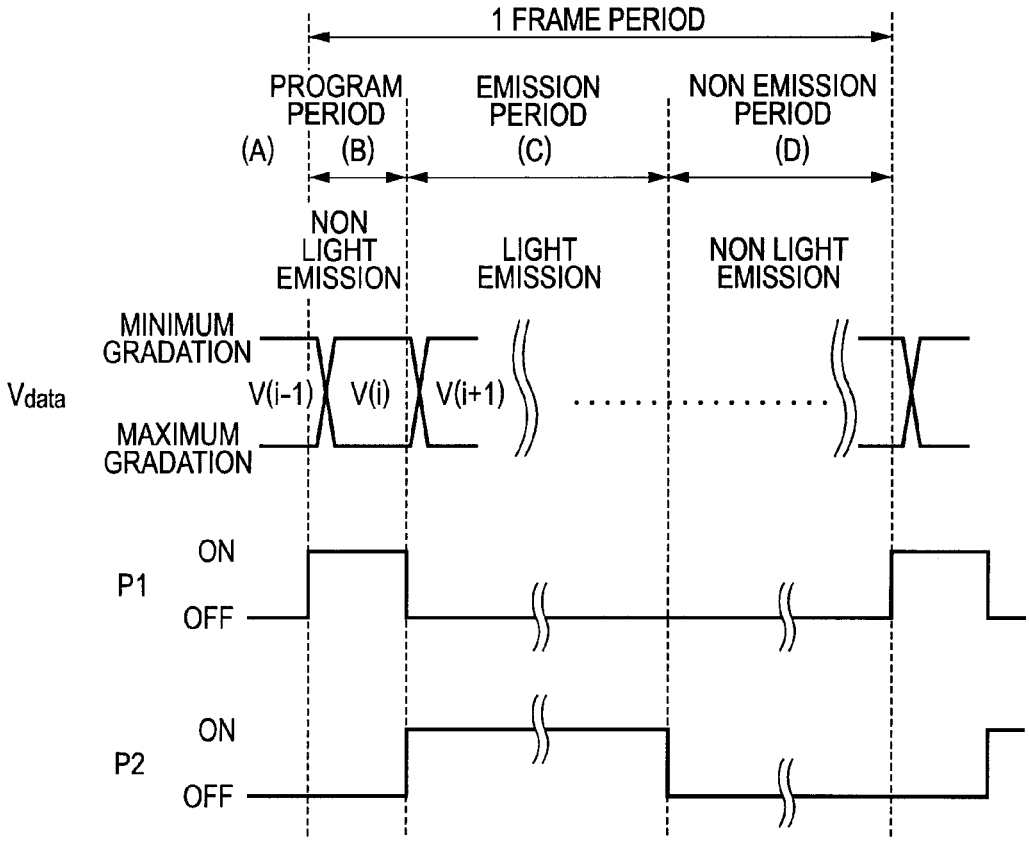

FIG. 2A is a diagram illustrating an example of the pixel circuit to be provided for each of the pixels 100, and FIG. 2B is a timing chart indicating an example of a driving sequence of the pixel circuit illustrated in FIG. 2A.

The pixel circuit illustrated in FIG. 2A is constituted by a selecting transistor 161 acting as a switching transistor, a driving transistor 162, an emission period controlling transistor 163, a storage capacitor 15, an organic EL element 17, a power supply line 13, a grounding line 14, a data line 121, and the control lines 111 and 112. Here, each of the selecting transistor 161 and the emission period controlling transistor 163 is an N-type transistor, and the driving transistor 162 is a P-type transistor. The selecting transistor 161 is disposed so that its gate electrode is connected to the control line 111, its drain electrode is connected to the data line 121, and its source electrode is connected to the gate electrode of the driving transistor 162. The driving transistor 162 is disposed so that its source electrode is connected to the power supply line 13, and its drain electrode is connected to the drain electrode of the emission period controlling transistor 163. The emission period controlling transistor 163 is disposed so that its gate electrode is connected to the control line 112, and its source electrode is connected to the anode of the organic EL element 17. The cathode of the organic EL element 17 is connected to the grounding line 14. The storage capacitor 15 is disposed between the power supply line 13 and the gate electrode of the driving transistor 162. The data line 121 is connected to the gate electrode of the driving transistor 162 and one electrode of the storage capacitor 15 through the selecting transistor 161.

It is preferable to provide the storage capacitor 15 as in the present embodiment, for the reason that it is possible to maintain the potential of the gate electrode of the driving transistor 162. Moreover, it is preferable to provide the control line 111 and the selecting transistor 161 as in the present embodiment, for the reason that it is possible to control the supplying of the data voltage by the control line 111 and the selecting transistor 161.

The driving transistor 162 may be an N-type transistor. In this case, it is desirable not to dispose the storage capacitor 15 between the power supply line 13 and the gate electrode of the driving transistor 162, but to dispose it between the grounding line 14 and the gate electrode of the driving transistor 162. Besides, each of the selecting transistor 161 and the emission period controlling transistor 163 may be a P-type transistor.

In the timing chart illustrated in FIG. 2B, a one frame period is divided into three periods, i.e., a program period (period (B)), an emission period (period (C)) and a non emission period (period (D)). Here, the program period is the period in which the data voltage is written into the target pixel, the emission period is the period in which the organic EL element of the target pixel emits light, and the non emission period is the period in which the organic EL element of the target pixel is controlled not to emit light. The emission period and the non emission period are defined by on and off states of the emission period controlling transistor. Incidentally, a ratio of the emission period and the non emission period subsequent to the program period in the one frame period may arbitrarily be set. In the driving sequence of the organic EL displaying apparatus 1 according to the present embodiment, it only has to set the period (C) after the period (B) on a time axis, and it is possible to set to have a time interval between the period (C) and the period (B). In the drawing, symbols V(i−1), V(i) and V(i+1) indicate the data voltages $V_{data}$ to be input respectively to the pixel circuits at the (i−1)-th row (one-prior row of target row), the i-th row (target row) and the (i+1)-th row (one-posterior row of target row) on the target column.

A period (A) is the program period at the one-prior row of the target row, and is also the period included in the period (D) in the one-prior frame of the target row. In the pixel circuit at the target row, a low-level signal is input to the control line 111, whereby the selecting transistor 161 is set to an off state. Consequently, the data voltage V(i−1) being the gradation displaying data at the one-prior row is not input to the pixel circuit at the i-th row being the target row.

In the period (B), a high-level signal is input to the control line 111 in the pixel circuit at the target row, whereby the selecting transistor 161 is set to an on state. Consequently, the data voltage V(i) being the gradation displaying data at the i-th row is input to the pixel circuit at the i-th row being the target row. Thus, an electric charge corresponding to the input data voltage V(i) is charged to the storage capacitor 15, whereby programming of the gradation displaying data is performed. Further, in this period, a low-level signal is input to the control line 112, whereby the emission period controlling transistor 163 is set to an off state. Consequently, a current is not supplied to the organic EL element 17, whereby the organic EL element 17 does not emit light.

In the period (C), a low-level signal is input to the control line 111 in the pixel circuit at the target row, whereby the selecting transistor 161 is set to an off state. Consequently, the data voltage V(i+1) being the gradation displaying data at the next target row is not input to the pixel circuit at the i-th row being the target row. Further, in this period, a high-level signal is input to the control line 112, whereby the emission period controlling transistor 163 is set to an on state. Consequently, the electric charge charged to the storage capacitor 15 in the period (B) and the current corresponding to the potential of the gate electrode of the driving transistor 162 are supplied to the organic EL element 17, whereby the organic EL element 17 emits light with the luminance of gradation according to the supplied current.

In the period (D), a low-level signal is input to the control line 112 in the pixel circuit at the target row, whereby the emission period controlling transistor 163 is set to an off state. Consequently, a current is not supplied to the organic EL element 17, whereby the organic EL element 17 does not emit light.

As described above, in the driving sequence of the organic EL displaying apparatus 1 according to the present embodiment, since the on state and the off state of the emission period controlling transistor 163 are controlled in response to the control signal P2 supplied on the control line 112, the emission period of the organic EL element 17 is controlled. Incidentally, in the present invention, driving for performing emission period controlling implies driving having a non emission period (period (D) in the above example) other than a period (period (B) in the above example) in which programming of a target row is performed in a driving sequence.

Figure 3:
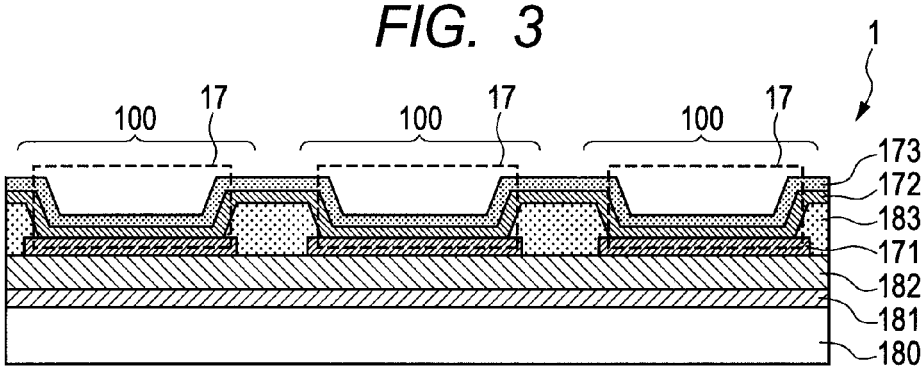
FIG. 3 is a partial cross-section perspective diagram illustrating a displaying region of the organic EL displaying apparatus.

FIG. 3 is a partial cross-section perspective diagram illustrating the displaying region 10 of the organic EL displaying apparatus 1 illustrated in FIG. 1. In the organic EL displaying apparatus 1 of FIG. 3, a circuit element layer 181 is formed on a substrate. Here, a switching transistor (not illustrated), a driving transistor (not illustrated), a wiring structure (not illustrated) consisting of a control line, a data line, a power supply line and a grounding line, and a storage capacitor (not illustrated) are formed in the circuit element layer 181. A planarization layer 182 is formed on the circuit element layer 181. Further, a contact hole (not illustrated) for connecting a first electrode 171 formed on the planarization layer and the circuit element layer 181 to each other is formed in the planarization layer 182. Further, an organic component layer 172 having at least a light emission layer and a second electrode 173 are formed in this order on the first electrode 171.

The first electrodes 171 are separately formed for the respective pixels. In FIG. 3, the organic component layer 172 is continuously formed across the adjacent pixels. However, when emission colors of the adjacent pixels are different from each other, it is necessary to form at least the emission layer for each pixel. For example, when the emission layer is formed by a mask vapor deposition method, the emission layer forming region can be defined using a shadow mask having an opening portion at the region corresponding to the pixel. The second electrode 173 is formed entirely on the displaying region 10, and is connected to the grounding line 14 (not illustrated) at a region outside the displaying region 10. However, the second electrode 173 may be connected to the grounding line 14 within the displaying region 10. Here, a laminated body which consists of the first electrode 171, the second electrode 173, and the organic component layer 172 interposed between the first electrode 171 and the second electrode 173 is called the organic EL element 17. Incidentally, as illustrated in FIG. 3, the emission region of each of the organic EL elements 17 may be partitioned by banks 183 provided so as to cover the edges of the first electrode 171 on the planarization layer 182. In other words, the emission region of each of the organic EL elements may be partitioned by the opening provided on the bank 183 in correspondence with the first electrode 171.

Although not illustrated, a sealing structure for protecting the organic EL element 17 from moisture and oxygen may be formed on the second electrode 173. As the sealing structure, it is possible to use a structure that a protection layer of a single layer or laminated plural layers is provided, a structure that a sealing member consisting of a glass substrate, a sealing cap or the like is provided, or a structure that the sealing member is provided on the protection layer.

The constitution of the organic EL displaying apparatus 1 illustrated in FIG. 3 can be formed using known materials in a known method. Incidentally, the organic EL element 17 illustrated in FIG. 3 may be either of a top-emission organic EL element and a bottom-emission organic EL element.

Incidentally, a driving circuit which is suitably used in the organic EL displaying apparatus 1 in the present embodiment is constituted so as to satisfy the following expression (1) or (2) in the driving sequence as illustrated in FIGS. 2A and 2B.

$$R_{off}_ILM \geq R_{bk}_Dr \quad (1)$$

$$I_{leak} \leq I_{bk} \quad (2)$$

The symbol $R_{off}$_ILM indicates the resistance between the source electrode and the drain electrode of the emission period controlling transistor 163 at a time when the emission period controlling transistor 163 is off. Here, the time when the emission period controlling transistor 163 is off is equivalent to the state that the voltage between the gate and the source of the emission period controlling transistor 163 is set to be equal to or smaller than a threshold voltage. The symbol $R_{bk}$_Dr indicates the resistance between the source electrode and the drain electrode of the driving transistor 162 in a state that the data voltage (minimum gradation displaying data voltage) for flowing the current according to the minimum gradation in the organic EL element is applied to the gate electrode of the driving transistor 162.

The symbol $I_{leak}$ indicates the value of the leak current flowing in the organic EL element in a state that the data voltage (maximum gradation displaying data voltage) for flowing the current according to the maximum gradation in the organic EL element is applied to the gate electrode of the driving transistor 162 and in the non emission period in which the emission period controlling transistor 163 is off. The symbol $I_{bk}$ indicates the value of the current flowing in the organic EL element in the state that the minimum gradation displaying data voltage is applied to the gate electrode of the driving transistor 162 and in the emission period in which the emission period controlling transistor 163 is on.

In the present embodiment, since the driving circuit satisfies the above expression (1) or (2), the emission luminance of the organic EL element by the leak current at the time when the emission period controlling transistor 163 is off is not larger than luminance (hereinafter, called minimum gradation luminance $L_{bk}$) corresponding to the minimum gradation displaying data in the emission period, even in case of performing the driving to control the emission period. Therefore, the light emission which is larger than the minimum gradation luminance in the emission period is not superposed in the non emission period, whereby it is possible to suppress that a luminance variation occurs.

Figure 4:
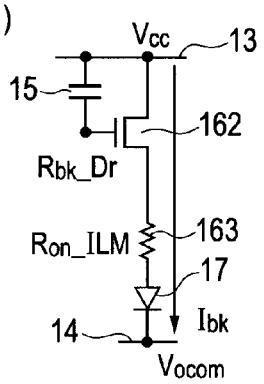
FIG. 4 is a diagram indicating a driving state of the pixel circuit illustrated in FIG. 2A.
Figure 4:
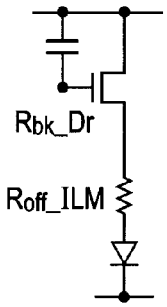
Figure 4:
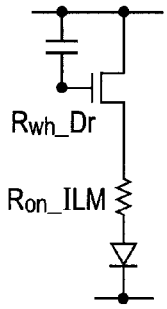
Figure 4:
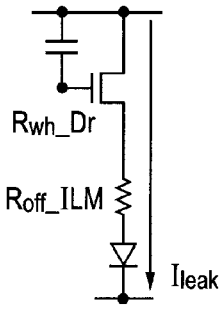

Subsequently, the reason why the occurrence of the luminance variation can be suppressed by satisfying the above expression (1) or (2) will be described with reference to FIG. 4. FIG. 4 is the diagram indicating the states of the pixel circuit illustrated in FIG. 2A in the periods (C) and (D) illustrated in FIG. 2B. In the periods (C) and (D), since the selecting transistor 161 is in the off state and is thus electrically disconnected from the data line 121, the selecting transistor 161 and the data line 121 are omitted from the drawing. On the other hand, the emission period controlling transistor 163 is illustrated as the resistor.

More specifically, (1) of FIG. 4 shows the pixel circuit in the period (C) and (2) of FIG. 4 shows the pixel circuit in the period (D), in the case where the minimum gradation displaying data voltage is applied to the gate electrode of the driving transistor 162. Further, (3) of FIG. 4 shows the pixel circuit in the period (C) and (4) of FIG. 4 shows the pixel circuit in the period (D), in the case where the maximum gradation displaying data voltage is applied to the gate electrode of the driving transistor 162.

It should be noted that, in the following description, the one frame period in which the minimum gradation displaying data is programmed in the program period of the target pixel may be called a minimum gradation displaying time, and the one frame period in which the maximum gradation displaying data is programmed in the program period of the target pixel may be called a maximum gradation displaying time.

The resistance between the source electrode and the drain electrode of the driving transistor 162 in the states of (1) and (2) of FIG. 4 is indicated by $R_{bk}$_Dr, and the resistance between the source electrode and the drain electrode of the driving transistor 162 in the states of (3) and (4) of FIG. 4 is indicated by $R_{wh}$_Dr. Moreover, the resistance between the source electrode and the drain electrode of the emission period controlling transistor 163 in the states of (1) and (3) of FIG. 4 is indicated by $R_{on}$_ILM, and the resistance between the source electrode and the drain electrode of the emission period controlling transistor 163 in the states of (2) and (4) of FIG. 4 is indicated by $R_{off}$_ILM.

In the state of (1) of FIG. 4, the current $I_{bk}$ according to a voltage between power supply line potential $V_{cc}$ and grounding line potential $V_{ocom}$, the resistances $R_{bk}$_Dr and $R_{on}$_ILM, and the voltage drops in the circuit elements other than the driving transistor 162 and the emission period controlling transistor 163 on the wiring route between the power supply line and the grounding line flows in the organic EL element. The emission luminance of the organic EL element at this time is the minimum gradation luminance $L_{bk}$.

In the state of (2) of FIG. 4, a current $I_{bk}$_off according to the voltage between the power supply line potential $V_{cc}$ and the grounding line potential $V_{ocom}$, the resistances $R_{bk}$_Dr and $R_{off}$_ILM, and the voltage drops in the circuit elements other than the driving transistor 162 and the emission period controlling transistor 163 on the wiring route between the power supply line and the grounding line flows in the organic EL element.

In the state of (3) of FIG. 4, a current $I_{wh}$ according to the voltage between the power supply line potential $V_{cc}$ and the grounding line potential $V_{ocom}$, the resistances $R_{wh}$_Dr and $R_{on}$_ILM, and the voltage drops in the circuit elements other than the driving transistor 162 and the emission period controlling transistor 163 on the wiring route between the power supply line and the grounding line flows in the organic EL element. The emission luminance of the organic EL element at this time is the luminance corresponding to the maximum gradation displaying data, and is called maximum gradation luminance $L_{wh}$.

In the state of (4) of FIG. 4, the current $I_{leak}$ according to the voltage between the power supply line potential $V_{cc}$ and the grounding line potential $V_{ocom}$, the resistances $R_{wh}$_Dr and $R_{off}$_ILM, and the voltage drops in the circuit elements other than the driving transistor 162 and the emission period controlling transistor 163 on the wiring route between the power supply line and the grounding line flows in the organic EL element. The emission luminance of the organic EL element at this time is called maximum gradation leak luminance $L_{leak}$. Hereinafter, also in a case where the data voltage other than the maximum gradation displaying data is programmed to the gate electrode of the driving transistor 162, the current flowing in the organic EL element and the emission luminance of the organic EL element in the period (D) or when the emission period controlling transistor 163 is off are called the leak current and the leak luminance respectively.

Since the state of (1) of FIG. 4 corresponds to the minimum gradation displaying time and the state (4) of FIG. 4 corresponds to the time when the emission period controlling transistor is off, the currents flowing in the organic EL element are small in both the states, whereby the voltage drops in the organic EL element can be considered to be equivalent in both the states of (1) and (4) of FIG. 4. Therefore, in the states of (1) and (4) of FIG. 4, the voltage between the power supply line potential $V_{cc}$ and the grounding line potential $V_{ocom}$ and the voltage drops in the circuit elements other than the driving transistor 162 and the emission period controlling transistor 163 on the wiring route between the power supply line and the grounding line are common. Consequently, the magnitude relation between $I_{bk}$ and $I_{leak}$ is determined by the magnitude relation between the combined resistance of $R_{bk}$_Dr and $R_{on}$_ILM and the combined resistance of $R_{wh}$_Dr and $R_{off}$_ILM. Here, since $R_{on}$_ILM and $R_{wh}$_Dr are sufficiently smaller than $R_{bk}$_Dr and $R_{off}$_mM respectively, the magnitude relation between $I_{bk}$ and $I_{leak}$ is determined by the magnitude relation between $R_{bk}$_Dr and $R_{off}$_ILM.

Consequently, when the above expression (1) is satisfied, then the above expression (2) can be satisfied. Generally, a current-luminance characteristic of the organic EL element has a positive correlation. Therefore, when it can be confirmed that either the above expression (1) or (2) is satisfied in a certain pixel, it is said that the maximum gradation leak luminance $L_{leak}$ is controlled to be equal to or smaller than the minimum gradation luminance $L_{bk}$ in the relevant certain pixel. Incidentally, in a defective pixel which includes a defective transistor or the like produced in a manufacturing process, there is a case where either the above expression (1) or (2) is satisfied. However, in the present invention, the relevant defective pixel is not considered as the target, but only a normal pixel is considered as the target.

Here, the defective pixel will be defined as follows. That is, the same gradation displaying data is programmed to all the pixels within the displaying region, a proportion of the emission period in the periods other than the program period in the one frame period is set to t, and the organic EL displaying apparatus is driven so as to satisfy $0<t\leq 1$. Here, average luminance in the one frame period of the average luminance in the displaying region obtained by measuring the luminance of the overall displaying region is set to $L_{mean}$. At this time, when the average luminance in the one frame period of a certain pixel is equal to or smaller than 0.8 $L_{mean}$ or equal to or larger than 1.2 $L_{mean}$, the relevant certain pixel is defined as the defective pixel. This is because the pixel of which the luminance is within a range of 0.8 $L_{mean}$ or smaller or a range of 1.2 $L_{mean}$ or higher impairs uniformity in the displaying region. Namely, it should be noted that the normal pixel is the pixel which does not correspond to the defective pixel. Incidentally, it should be noted that the average luminance in the one frame period can be obtained by dividing the accumulated luminance in the one frame period by the time of the one frame period, and that the accumulated luminance is the value which is obtained by temporarily integrating the emission luminance of the organic EL element for the one frame period.

Incidentally, the luminance of the displaying region and the luminance of the pixel are measured in the following manner. Namely, a measuring range is first set on the overall displaying region or the partial pixel by using a luminance measuring unit. Then, when the organic EL displaying apparatus is driven in this state, the luminance on the overall displaying region or the partial pixel can be measured by the luminance measuring unit at each timing in the driving sequence or in the predetermined period. In any case, for example, a measuring unit in which a photosensor and an oscilloscope are mutually connected to each other can be used as the luminance measuring unit.

Concretely, the defective pixel includes a black-spot pixel in which the organic EL element does not emit light even in the emission period, a bright-spot pixel in which the organic EL element emits light with luminance (e.g., luminance equal to or higher than the maximum gradation luminance) higher than that of the normal pixel even at the minimum gradation displaying time or in the non emission period, and the like. In the black-spot pixel, when the maximum gradation displaying data is programmed as an example to all the pixels within the displaying region, the proportion t of the emission period in the periods other than the program period in the one frame period is set to 0.7, and the organic EL displaying apparatus is driven, then the luminance is equal to or smaller than 0.8 of the average luminance $L_{mean}$ in the displaying region. Thus, the black-spot pixel corresponds to the defective pixel. Besides, in the bright-spot pixel, when the minimum gradation displaying data is programmed as an example to all the pixels within the displaying region, the proportion t of the emission period in the periods other than the program period in the one frame period is set to 0.7, and the organic EL displaying apparatus is driven, then the luminance is equal to or higher than 1.2 $L_{mean}$ in the displaying region. Thus, the bright-spot pixel corresponds to the defective pixel.

More specifically, the black-spot pixel is generated when short circuit between the first electrode and the second electrode, lack of the partial wiring in the circuit element layer, or the like occurs due to contamination of a foreign matter in the manufacturing process. Besides, the bright-spot pixel is generated when short circuit among the partial wirings in the circuit element layer, short circuit between the gate electrode and the activate layer, the source electrode or the drain electrode of the transistor, or the like occurs due to contamination of a foreign matter in the manufacturing process.

In the driving for the emission period control, the gradation display is performed based on the emission luminance of the organic EL element in the emission period (C), and each gradation is set as the luminance between the minimum gradation luminance and the maximum gradation luminance based thereon. Incidentally, in the driving for the emission period control, the average luminance obtained by dividing the accumulated luminance in the one frame period by the time of the one frame period is viewed as brightness by an observer. In the organic EL displaying apparatus 1 of the present embodiment, since the emitted light of the leak luminance larger than the minimum gradation luminance being the basis for setting the gradation in the non emission period (D) is not superposed on the emitted light in the emission period (C), it is possible to suppress a luminance variation at the maximum gradation displaying time.

Further, in the above description, only the minimum gradation luminance and the leak current flowing in the organic EL element in the period (D) in the case where the maximum gradation displaying data voltage is being applied to the gate electrode of the driving transistor 162 are compared with each other. In the case where the data voltage for displaying the gradation lower than the maximum gradation is being applied, the resistance between the source electrode and the drain electrode of the driving transistor 162 is larger than $R_{wh}$_Dr. Namely, when the above expression (1) or (2) is satisfied, also the leak current in the case where the data voltage for displaying the gradation lower than the maximum gradation is being applied can be made smaller than $I_{bk}$, whereby it is possible to control the leak luminance to be lower than the minimum gradation luminance. Therefore, even when the data voltage for displaying the gradation lower than the maximum gradation is applied, it is possible to suppress a luminance variation at each gradation displaying time, as well as the case where the maximum gradation displaying data voltage is applied.

As just described, in the present embodiment, even when the driving for the emission period control is performed, the leak luminance at the time when the emission period controlling transistor in the non emission period is off does not come to be larger than the minimum gradation luminance in the emission period. Therefore, it is possible to suppress that a luminance variation occurs.

Example 1

A concrete example of the organic EL displaying apparatus 1 according to the first embodiment will be described hereinafter. Here, it should be noted that the present invention is not limited to the following examples. Moreover, it should be noted that the present invention is not limited by the polarities or the sizes of the transistors, the pixel arrangements, the pixel pitches, or the like, used in the following examples.

In this example, in the pixel circuit illustrated in FIG. 2A, the selecting transistor 161 is an N-type transistor, the driving transistor 162 is a P-type transistor, and the emission period controlling transistor 163 is an N-type transistor.

In this example, the two-dimensional arrangement of the pixels 100 illustrated in FIG. 1 was set to 480 rows×1920 columns, and the pixel pitches of the pixels 100 in the row direction and the column direction were set to 94.5 μm and 31.5 μm respectively. Further, the pixels 100 were constituted so that pixels 100(R), 100(G) and 100(B) (all not illustrated) respectively having the organic EL elements for emitting red (R) light, green (G) light and blue (B) light were repeatedly arranged in the column direction in this order. Although this example paid attention to the pixel 100(R) having the organic EL element for emitting red light, it is of course possible to pay attention to another pixel having the organic EL element for emitting another color light.

The current value to be supplied to the organic EL element of each pixel in the emission period at the maximum gradation displaying time was set to $5\times10^{-7}$ A, and the gradation displaying data was set so that the contrast in the case where the proportion t ($0<t\leq1$) of the emission period in the periods other than the program period in the one frame period was 1 was 100000:1. Here, the contrast indicates the ratio of the accumulated luminance at the maximum gradation displaying time to the accumulated luminance at the minimum gradation displaying time, and such a definition will be available hereafter.

In this example, under such a design condition, the organic EL displaying apparatus 1 including the driving transistor 162 having its channel length L1 of 24 μm and its channel width W1 of 10 μm and the emission period controlling transistor 163 having its channel length L2 of 4 μm and its channel width W2 of 2.5 μm was manufactured in consideration of the above expression (1) or (2).

Figure 5:
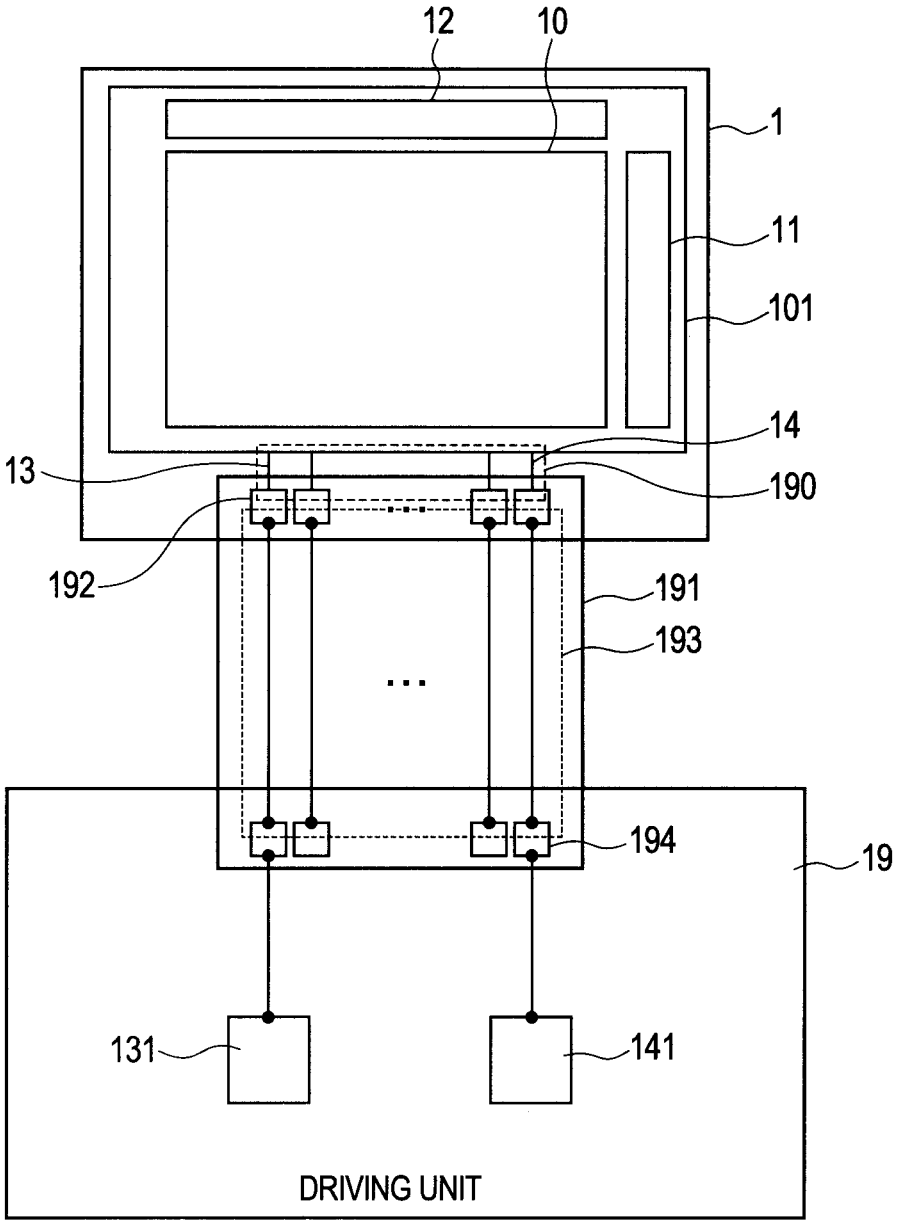
FIG. 5 is a wiring diagram for an evaluation of the organic EL displaying apparatus in Example 1.

As illustrated in FIG. 5, a wiring 190 including the power supply line 13 and the grounding line 14 of the manufactured organic EL displaying apparatus 1 was connected to a driving unit 19 through a flexible printed substrate 191. More specifically, the wiring 190 was connected to a wiring 193 in the flexible printed substrate 191 through connection portions 192 in the organic EL displaying apparatus 1, and further the wiring 193 was connected to the driving unit 19 through connection portions 194 in the driving unit 19. In the organic EL displaying apparatus 1, the wiring 190 was connected to the pixel circuits of the pixels 100 in the displaying region 10, the row controlling circuit 11, the column controlling circuit 12 and the like through a peripheral wiring region 101. Further, the power supply line 13 and the grounding line 14 were connected to the pixel circuits of the pixels 100 in the displaying region 10 in the organic EL displaying apparatus 1, and further connected respectively to a $V_{cc}$ power supply 131 and a $V_{ocom}$ power supply 141 in the driving unit 19.

The completed organic EL displaying apparatus 1 was driven according to the driving sequence condition illustrated in FIG. 2B, by setting the proportion t ($0<t\leq1$) of the emission period in the periods other than the program period in the one frame period to 0.7 and applying a voltage of 9.5V as the power supply line voltage (i.e., the voltage between the power supply line potential $V_{cc}$ and the grounding line potential $V_{ocom}$).

Then, it was evaluated whether or not the completed organic EL displaying apparatus 1 satisfied the expression (2). More specifically, the current value flowing in the organic EL element 17 in a red pixel 100*a* (R) arbitrarily selected from among the pixels 100 in the displaying region 10 was measured. Since the same pixel circuit was used to all the pixels and driven in the same manner, the color of the pixel to be evaluated may be another color.

Figure 6A:
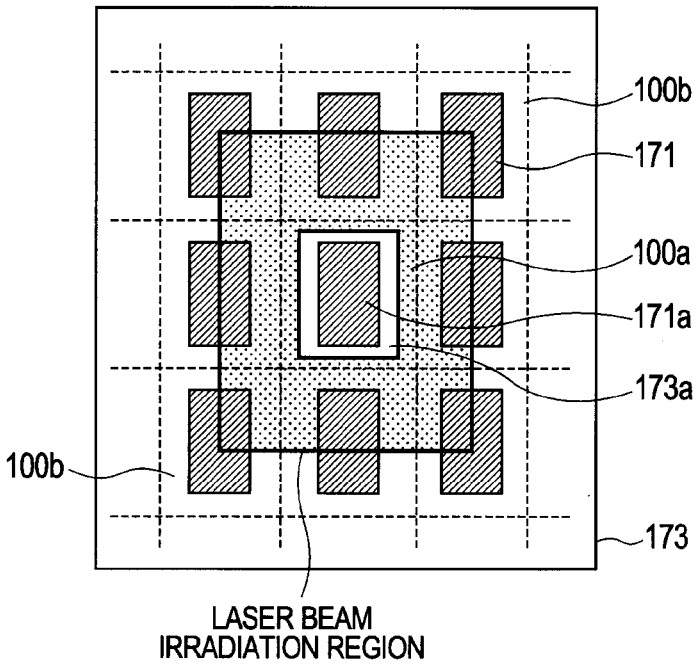
FIGS. 6A and 6B are diagrams for describing an evaluation method in which the wiring diagram illustrated in FIG. 5 is used.
Figure 6B:
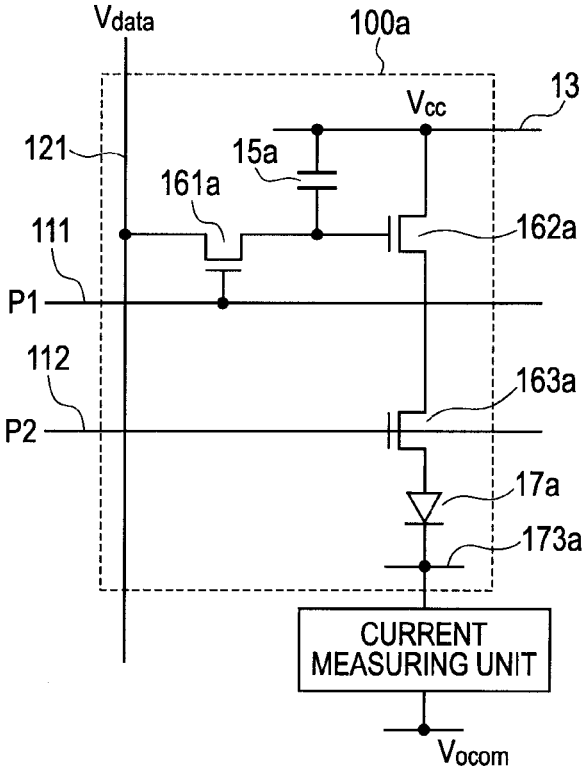

Here, a method of measuring the current value flowing in the organic EL element included in a pixel 100*a* will be described with reference to FIGS. 6A and 6B. FIG. 6A is the plan schematic diagram indicating the pixel 100*a* to be measured, a plurality of pixels 100*b* adjacent to the pixel 100*a*, and a laser beam irradiation region to be irradiated by a laser beam to separate the second electrode of the organic EL element included in the pixel 100*a* from other pixels. In FIG. 6A, the positional relations of the first electrode 171 and the second electrode 173 of the pixel 100*a* and the plurality of pixels 100*b* are indicated, and the constitution below the first electrode 171, the bank 183 and the organic component layer 172 are omitted. FIG. 6B is the schematic diagram indicating the pixel circuit of the pixel 100*a* and a connected state of a current measuring unit after the irradiation of the laser beam.

First, as illustrated in FIG. 6A, the laser beam is irradiated to the periphery (i.e., the laser beam irradiation region) of a first electrode 171*a* in the pixel 100*a* to electrically separate a second electrode 173*a* on the pixel 100*a* from the second electrode 173 on the pixels 100*b*. Here, the laser beam irradiation region may be a region in which the laser beam is not irradiated to the first electrode 171*a* of the pixel 100*a*, and the laser beam may be irradiated to the plurality of pixels 100*b*. When the bank 183 is provided, the laser beam irradiation region may be a region in which the laser beam is not irradiated to the opening portion of the bank 183 on the first electrode 171*a*. Here, a YAG (yttrium aluminum garnet) laser may be used as a laser for irradiating the laser beam.

Subsequently, as illustrated in FIG. 6B, the current measuring unit is electrically connected between the second electrode 173*a* of the pixel 100*a* and the grounding line potential $V_{ocom}$. In this state, when the organic EL displaying apparatus 1 is driven according to the driving sequence illustrated in FIG. 2B, the current value flowing in an organic EL element 17*a* of the pixel 100*a* can be measured by the current measuring unit at each timing in the driving sequence. Here, an ammeter, an oscilloscope, a semiconductor parameter analyzer or the like can be used as the current measuring unit.

First, the minimum gradation displaying data voltage was programmed to the pixel 100*a* (R) in the period (B) of FIG. 2B. Then, the voltage of 12V was applied as a high level signal to the control line 112 of the pixel 100*a* (R) in the period (C). At this time, when the current $I_{bk}$ flowing in the organic EL element 17 of the pixel 100*a* (R) in the period (C) was measured by the above measuring method, the current value of $5\times10^{-12}$ A was obtained. Incidentally, the measuring timing may be set as arbitrary one timing in the period (C). Alternatively, the average current value in a predetermined period included in the period (C) may be set to $I_{bk}$.

Subsequently, the maximum gradation displaying data voltage was programmed to the pixel 100*a* (R) in the period (B). Then, the voltage of 0V was applied as a low level signal to the control line 112 of the pixel 100*a* (R) in the period (D). At this time, when the current $I_{leak}$ flowing in the organic EL element 17 of the pixel 100*a* (R) in the period (D) was measured, the current value of $5.4\times10^{-13}$ A was obtained. Incidentally, the measuring timing may be set as arbitrary one timing in the period (D). Alternatively, the average current value in a predetermined period included in the period (D) may be set to $I_{leak}$.

As a result of the measurement, $I_{leak}=5.4\times10^{-13}$ A$\leq I_{bk}=5\times10^{-12}$ A was obtained in the pixel 100*a* (R) included in the organic EL displaying apparatus 1 in this example, and this satisfied the above expression (2). Therefore, in the pixel 100*a* (R), even in case of performing the driving for controlling the emission period, the emission luminance of the organic EL element due to the leak current at the off time of the emission period controlling transistor 163 in the non emission period was not higher than the minimum gradation luminance in the emission period, whereby the occurrence of the luminance variation could be suppressed in the pixel 100*a* (R).

In the organic EL displaying apparatus 1 of the present embodiment, the current value flowing in the organic EL element 17 in each of other red pixels 100*a* (R) was measured in the same manner as described above, all the measured pixels satisfied the above expression (2). Since the pixel circuit same as that in the red pixel is used to the blue pixel and the green pixel, the occurrence of the luminance variation can be suppressed for the pixels of all the colors.

When the luminance of the organic EL element included in the pixel 100*a* (R) was measured actually, the maximum gradation leak luminance $L_{leak}$ was smaller than the minimum gradation luminance $L_{bk}$. Subsequently, a method of measuring the luminance of the organic EL element included in a pixel 100*a* will be described. First, the range to be measured is set in the pixel 100*a* by using the luminance measuring unit. In this state, when the organic EL displaying apparatus 1 is driven according to the driving sequence illustrated in FIG. 2B in the connection state illustrated in FIG. 6B, then the luminance of the organic EL element 17 of the pixel 100*a* can be measured by the luminance measuring unit at each timing in the driving sequence. Here, the measuring unit in which the photosensor is connected to the oscilloscope can be used as the luminance measuring unit.

Incidentally, the luminance may be measured before the second electrode 173*a* on the pixel 100*a* and the second electrode 173 on the pixels 100*b* are electrically separated from each other. Even in this case, when the organic EL displaying apparatus 1 is driven according to the driving sequence illustrated in FIG. 2B in the state that the measuring range of the luminance measuring unit is being set to the pixel 100*a*, then the luminance of the organic EL element 17 of the pixel 100*a* can be measured in the same manner at each timing in the driving sequence.

(Modification of Example 1)

This modification is different from Example 1 in the point that the current flowing in the organic EL element is not evaluated for each pixel but the current flowing in the organic EL element of the pixel 100 is evaluated for each row. More specifically, it is evaluated whether or not a sum total $I_{bk}$_1LINE of the current $I_{bk}$ flowing in the organic EL element of each pixel included in an arbitrarily selected k-th row and a sum total $I_{leak}$_1LINE of the current $I_{leak}$ flowing in the organic EL element of each pixel of the k-th row satisfy the following expression (2)'. Here, k is a natural number.

$$I_{leak}_1\text{LINE}\leq I_{bk}_1\text{LINE} \quad (2)'$$

Figure 7:
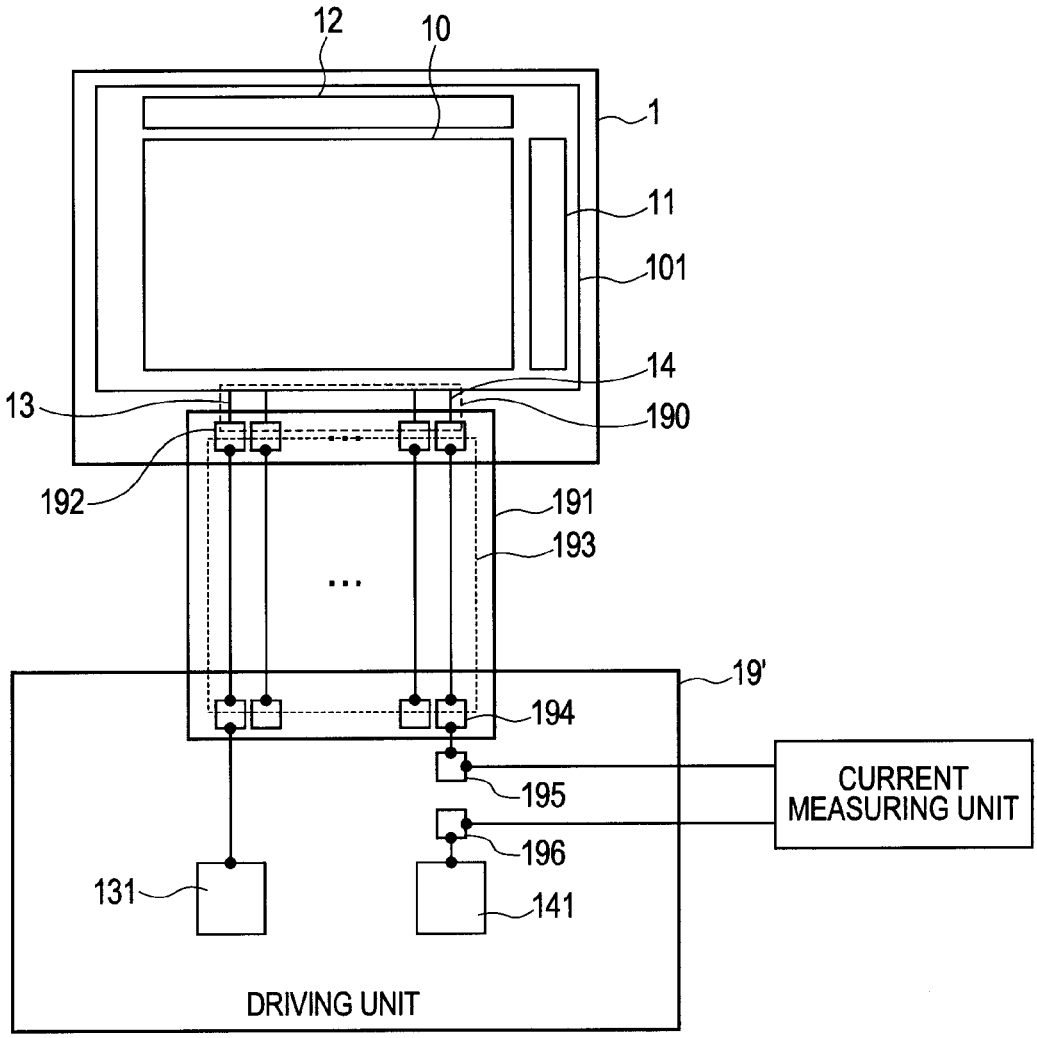
FIG. 7 is a wiring diagram for another evaluation of the organic EL displaying apparatus in Example 1.

First, as well as Example 1, the organic EL displaying apparatus 1 was manufactured. Then, the wiring 190 including the power supply line 13 and the grounding line 14 of the manufactured organic EL displaying apparatus 1 was connected to a driving unit 19' through the flexible printed substrate 191, as illustrated in FIG. 7. Here, the driving unit 19' is the same as the driving unit 19 except that the connection portion 194 connected to the ground line 14 is not connected to the $V_{ocom}$ power supply 141. Then, the organic EL displaying apparatus was driven according to the driving sequence illustrated in FIG. 2B, and the sum total of the current values flowing in the organic EL elements 17 of all the pixels 100 within the displaying region 10 was evaluated.

A method of measuring the sum total of the current values flowing in the organic EL elements of all the pixels within the displaying region in this modification will be described with reference to FIG. 7. Namely, FIG. 7 is the schematic diagram illustrating the connection state of the current measuring unit.

As illustrated in FIG. 7, the current measuring unit is electrically connected between a wiring end 195 connected to the grounding line 14 and a wiring end 196 connected to the $V_{ocom}$ power supply 141 in the driving unit 19'. In this state, when the organic EL displaying apparatus 1 is driven according to the driving sequence illustrated in FIG. 2B, the sum total of the current values flowing in the organic EL elements of all the pixels within the displaying region can be measured at each timing in the driving sequence. Here, the ammeter, the oscilloscope, the semiconductor parameter analyzer or the like can be used as the current measuring unit.

In this sum total measuring method, for all the rows, the minimum gradation displaying data voltage was programmed to each pixel included in each row in the period (B) of each row, and the voltage of 12V was applied as a high level signal to the control line 112 of each row in the period (C) of each row. At this time, when a sum total I1 of the current values flowing in the organic EL elements 17 of all the pixels 100 within the displaying region 10 in the period (C) at an arbitrarily selected measurement-target row (k-th row) was measured, the current value of $34.1\times10^{-7}$ A was obtained. In this modification, k=50 was set. In any case, although k=50 was set, k may be a natural number which satisfies k≤480 in this modification. Incidentally, the measuring timing may be set as arbitrary one timing in the period (C) at the k-th row.

Moreover, in the period (B) of each row, the maximum gradation displaying data voltage was programmed to each pixel included in the k-th row, and the minimum gradation displaying data voltage was programmed to each pixel included in each of all the rows other than the k-th row. Then, in the period (D) of each row, the voltage of 0V was applied as a low level signal to the control line 112 of each row. At this time, when a sum total I2 of the current values flowing in the organic EL elements 17 of all the pixels 100 within the displaying region 10 in the period (D) at the k-th row was measured, the current value of $34.0\times10^{-7}$ A was obtained. Incidentally, the measuring timing may be set as arbitrary one timing in the period (D) at the k-th row.

Therefore, sum total I2=$34.0\times10^{-7}$ A≤sum total I1=$34.1\times10^{-7}$ A was obtained in this modification.

Here, the sum total of the currents flowing in the respective pixels included in all the rows other than the k-th row at the I1 measuring time is equal to that at the I2 measuring time, a difference between the sum totals I1 and I2 of the current values corresponds to a difference between the sum total $I_{bk}$_1LINE of the current $I_{bk}$ and the sum total $I_{leak}$_1LINE of the current $I_{leak}$ respectively flowing in the organic EL element 17 of each pixel included in the k-th row.

Therefore, the relation of the expression (2)' was satisfied in this modification. When the sum total $I_{bk}$_1LINE of the current $I_{bk}$ and the sum total $I_{leak}$_1LINE of the current $I_{leak}$ respectively flowing in the organic EL element of each pixel included in the k-th row satisfy the relation of the expression (2)', the average of the current values flowing in the organic EL element of each pixel included in the k-th row calculated from each sum total current satisfies the expression (2). Therefore, the occurrence of the luminance variation of the average luminance for each row could be suppressed in the k-th row. As just described, it is possible to evaluate the relation of the expression (2) not by using the average value of the currents for each pixel but by using the average value of the currents for each row.

Further, the evaluation may be performed to the plurality of continuous rows by performing the same measurement. More specifically, it is evaluated whether or not a sum total $I_{bk}$_LINES of the current $I_{bk}$ flowing in the organic EL element of each pixel included in continuous q rows from arbitrarily selected k-th to (k+q−1)-th rows and a sum total $I_{leak}$_LINES of the current $I_{leak}$ also flowing in the organic EL element of each pixel included in the continuous q rows from the arbitrarily selected k-th to (k+q−1)-th rows satisfy the following expression (2)". Here, each of k and q is a natural number.

$$I_{leak}_\text{LINES} \leq I_{bk}_\text{LINES} \quad (2)''$$

By the measuring method like this, it is possible to enlarge the value of the difference between these two currents and thus make the magnitude relation comparison easy.

A method of measuring the difference between the sum totals of the currents $I_{bk}$ and $I_{leak}$ for the continuous q rows, in the same manner as that of measuring the difference for the one row, will be described. Namely, for all the rows, the minimum gradation displaying data voltage is programmed to each pixel included in each row in the period (B) of each row in the driving sequence, and a high level signal is applied to the control line 112 of each row in the period (C) of each row. At this time, a sum total I1' of the current values flowing in the organic EL elements 17 of all the pixels 100 within the displaying region 10 is measured for the arbitrarily selected measurement-target continuous rows from the k-th row to the (k+q−1)-th row at arbitrary timing in the period in which the high level signal is being applied to the control lines 112 of all of these rows.

Further, in the period (B) of each row, the maximum gradation displaying data voltage is programmed to each pixel of each of the plurality of measurement-target continuous rows from the k-th row to the (k+q−1)-th row, and the minimum gradation displaying data voltage is programmed to each pixel of each of all the rows other than the rows from the k-th row to the (k+q−1)-th row. Then, in the period (D) of each row, a low level signal is applied to the control line 112 of each pixel of each row. At this time, a sum total I2' of the current values flowing in the organic EL elements 17 of all the pixels 100 within the displaying region 10 is measured at arbitrary timing in the period in which the low level signal is being applied to the control lines 112 of all the continuous rows from the k-th row to the (k+q−1)-th row.

A difference between the sum totals I1' and I2' of the current values thus measured corresponds to a difference between the sum total $I_{bk}$_LINES of the current $I_{bk}$ flowing in the organic EL element 17 of each pixel of the continuous rows from the k-th row to the (k+q−1)-th row and the sum total $I_{leak}$_LINES of the current $I_{leak}$ flowing in the organic EL element 17 of each pixel of the continuous rows from the k-th row to the (k+q−1)-th row, because the sum total of the current flowing in each pixel of all the rows other than the continuous rows from the k-th row to the (k+q−1)-th row in the I1' measuring time is the same as that in the I2' measuring time.

By doing so, the difference between the sum total of the current $I_{bk}$ and the sum total of the current $I_{leak}$ of the q rows can be measured.

Incidentally, with respect to the above-described continuous q rows from the k-th row to the (k+q−1)-th row, the period in which the high level signal is being applied to the control lines 112 of all of these rows is present in a case where the following expression (3) is satisfied.

$$q/m < t \quad (3)$$

Further, with respect to the continuous q rows from the k-th row to the (k+q−1)-th row, the period in which the low level signal is being applied to the control lines 112 of all of these rows is present in a case where the following expression (4) is satisfied.

$$q/m < (1-t) \quad (4)$$

Here, in the expressions (3) and (4), m is a natural number indicating the number of all the rows within the displaying region of the organic EL displaying apparatus, and q is a natural number indicating the number q of the plurality of continuous rows for which the difference between the sum total of the current $I_{bk}$ and the sum total of the current $I_{leak}$ respectively flowing in the organic EL element 17 is measured. Moreover, t is a real number indicating the proportion t ($0<t\leq 1$) of the emission period in the periods other than the program period in the one frame period.

For the organic EL displaying apparatus 1 as well as Example 1, q=100 was set, and the difference between the sum total of the current $I_{bk}$ and the sum total of the current $I_{leak}$ of the 100 rows from the arbitrarily selected k-th (=50) row was measured by the above-described method. The manufactured organic EL displaying apparatus 1 has m=480, and q=100 and t=0.7 here. Thus, the above expressions (3) and (4) are satisfied. Consequently, the period in which the high level signal is being applied to the control lines 112 of all of the continuous q rows from the k-th row to the (k+q−1)-th row and the period in which the low level signal is being applied to the control lines 112 of all of these rows are present. Incidentally, the high level signal to be applied to the control line 112 in the period (C) of each row was set to 12V, and the low level signal to be applied to the control line 112 in the period (D) of each row was set to 0V. At this time, the sum total I1' of the currents $I_{bk}$ flowing in the organic EL elements 17 of all the pixels 100 within the displaying region 10 was $36.6\times10^{-7}$ A, and the sum total I2' of the currents $I_{leak}$ flowing in the organic EL elements 17 of all the pixels 100 within the displaying region 10 was $28.0\times10^{-7}$ A. Therefore, in this modification, the sum total $I_{bk}$_LINES of the current $I_{bk}$ and the sum total $I_{leak}$_LINES of the current $I_{leak}$ respectively flowing in the organic EL element of each pixel included in the continuous rows from the k-th (=50) row to the (k+99)-th row satisfied the relation of the above expression (2)". For this reason, the average of the current values flowing in the organic EL element of each pixel included in the continuous rows from the k-th row to the (k+99)-th row calculated from each sum total current satisfies the expression (2). Consequently, the occurrence of the luminance variation of the average luminance for the each 100 rows could be suppressed in the continuous rows from the k-th row to the (k+99)-th row.

Further, the sum total $I_{bk}$_LINES of the current $I_{bk}$ and the sum total $I_{leak}$_LINES of the current $I_{leak}$ respectively flowing in the organic EL element of each pixel included in the plurality of rows, for the plurality of continuous rows (100 rows) from the k-th (k=1, 101, 201, 301) row to the (k+99)-th row and the plurality of continuous rows (80 rows) from the 401-st row to the 480-th row, were evaluated. As a result, the relation of the above expression (2)" was satisfied in all of the plurality of rows. Consequently, in the organic EL displaying apparatus 1 in the modification, the occurrence of the luminance variation of the average luminance in the displaying region 10 could be suppressed.

Incidentally, the average luminance, for each row or the plurality of rows, of the luminance of the organic EL element included in each pixel can be likewise measured by setting the measuring range of the luminance measuring unit to each row or the plurality of rows in the luminance measuring method in Example 1.

Comparative Example 1

This comparative example is an example that the selecting transistor 161 is an N-type transistor, the driving transistor 162 is a P-type transistor, and the emission period controlling transistor 163 is an N-type transistor. The organic EL displaying apparatus including the driving transistor 162 having its channel length of 24 μm and its channel width of 10 μm and the emission period controlling transistor 163 having its channel length of 4 μm and its channel width of 25 μm was manufactured. The wiring connection construction and the like of the organic EL displaying apparatus in this comparative example are the same as those of the organic EL displaying apparatus in Example 1 except for the emission period controlling transistor 163.

The organic EL displaying apparatus was driven according to the same driving sequence condition as that in Example 1, and the current value flowing in an organic EL element 17 of a red pixel 100*a*' (R) (not illustrated) arbitrarily selected from the plurality of pixels 100 within the displaying region 10 was measured in the method described in Example 1. More specifically, when the current $I_{bk}$ flowing in the organic EL element 17 of the pixel 100*a*' (R) in the period (C) was measured, the current value of $5\times10^{-12}$ A was obtained. Moreover, when the current $I_{leak}$ flowing in the organic EL element 17 of the pixel 100*a*' (R) in the period (D) was measured, the current value of $5.8\times10^{-12}$ A was obtained.

In the organic EL displaying apparatus of this comparative example, the current $I_{leak}$ was large as compared with Example 1 due to the size of the emission period controlling transistor 163 different from that in Example 1, whereby the above expression (2) was not satisfied in the pixel 100*a*' (R). Moreover, when the current value flowing in the organic EL element 17 was measured for other plurality of pixels 100 (R) in the same manner as that described above in the organic EL displaying apparatus of this comparative example, the above expression (2) was not satisfied in all of the measured pixels.

When the currents $I_{leak}$ and $I_{bk}$ do not satisfy the above expression (2), it can be said that the emission luminance (leak luminance) of the organic EL element due to the leak current in the non emission period of the period (D) is larger than the minimum gradation luminance in the emission period. In the driving for the emission period control, the gradation display is performed based on the emission luminance of the organic EL element in the emission period. Consequently, in the pixel in which the leak luminance is larger than the minimum gradation luminance, the emitted light of the organic EL element at the leak luminance larger than the minimum gradation luminance being the basis of the gradation setting in the non emission period is superposed to the emitted light in the emission period. Actually, the gradation display could not be performed correctly in this pixel, and the luminance variation occurred.

Example 2

In the organic El displaying apparatus according to the first embodiment, another concrete example different from Example 1 will be described. The organic EL displaying apparatus in this example is the same as the organic EL displaying apparatus in Example 1 except that the polarities of the selecting transistor 161 and the emission period controlling transistor 163 in the pixel are the P type and the contrast is set to 10000:1.

In the pixel circuit constitution illustrated in FIG. 2A, the selecting transistor 161 is the P-type transistor, the driving transistor 162 is the P-type transistor, and the emission period controlling transistor 163 is the P-type transistor. The current value to be supplied to the organic EL element of each color pixel in the emission period at the maximum gradation displaying time was set to $5\times10^{-7}$ A, and the gradation displaying data was set so that the contrast in the case where the proportion t ($0<t\leq1$) of the emission period in the periods other than the program period in the one frame period was 1 was 10000:1. In this example, under such a design condition, the organic EL displaying apparatus including, in each pixel, the driving transistor 162 having its channel length of 24 μm and its channel width of 10 μm and the emission period controlling transistor 163 having its channel length of 4 μm and its channel width of 10 μm was manufactured in consideration of the above expression (1) or (2).

The manufactured organic EL displaying apparatus was driven according to the driving sequence condition illustrated in FIG. 2B, by setting the proportion t ($0<t\leq1$) of the emission period in the periods other than the program period in the one frame period to 0.7 and applying a voltage of 9.5V as the power supply line voltage (i.e., the voltage between the power supply line potential $V_{cc}$ and the grounding line potential $V_{ocom}$). Then, the current value flowing in the organic EL element 17 included in a red pixel 100*a* (R) arbitrarily selected from among the plurality of pixels in the displaying region 10 was measured. Here, the method of measuring the flowing current for each pixel described in Example 1 was used as the current value measuring method.

In the period (B), the minimum gradation displaying data voltage was programmed to the pixel 100*a* (R). Then, in the period (C), the voltage of 0V was applied as a low level signal to the control line 112 connected to the pixel 100*a* (R). At this time, the current $I_{bk}$ flowing in the organic EL element 17 of the pixel 100*a* (R) was measured in the period (C), the current value of $5\times10^{-11}$ A was obtained. Moreover, in the period (B), the maximum gradation displaying data voltage was programmed to the pixel 100*a* (R). Then, in the period (D), the voltage of 12V was applied as a high level signal to the control line 112 connected to the pixel 100*a* (R). At this time, the current $I_{leak}$ flowing in the organic EL element 17 of the pixel 100*a* (R) was measured in the period (D), the current value of $2.0\times10^{-11}$ A was obtained.

Therefore, in the organic EL displaying apparatus in this example, the above expression (2) was satisfied in the pixel 100*a* (R). Consequently, the emission luminance of the organic EL element by the leak current at the time when the emission period controlling transistor 163 in the non emission period was off was not larger than the minimum gradation luminance in the emission period, even in case of performing the driving to control the emission period. Thus, the occurrence of the luminance variation in the pixel 100*a* (R) could be suppressed.

Subsequently, a more appropriate constitution in the organic EL displaying apparatus of the first embodiment which can switch over a high-luminance displaying mode and a low-luminance displaying mode to each other by changing the length of the emission period (C) using the emission period controlling transistor will be described.

In the organic EL displaying apparatus of this example, the mode switchover is performed by changing the length of the emission period, without changing the peak value of the luminance in the emission period between the high-luminance displaying mode and the low-luminance displaying mode. More specifically, the low-luminance displaying mode is achieved by shortening the emission period. In this case, as the proportion of the non emission period in the one frame period is prolonged by shortening the emission period, the luminance variation due to the superposition of the leak luminance in the non emission period becomes more conspicuous. Moreover, since the superposed leak luminance increases, a problem of deterioration of the contrast occurs.

Hereinafter, the deterioration of the contrast will be described in detail. Here, as described above, the contrast indicates the ratio between the accumulated luminance at the maximum gradation displaying time and the accumulated luminance at the minimum gradation displaying time.

In the one frame period, the proportion of the emission period in the periods other than the program period is defined as t ($0<t\leq 1$). With respect to the organic EL displaying apparatus which has the same constitution but of which the value of t has been changed, degree of the deterioration of the contract in case of $t<1$ in regard to the contrast in case of $t=1$ will be concretely described. Since the power supply voltage (i.e., the voltage between the power supply line potential $V_{cc}$ and the grounding line potential $V_{ocom}$) is common to these organic EL displaying apparatuses respectively having the different values of t, the emission luminance corresponds to the current value by the current-luminance characteristic of the organic EL element. Moreover, in the current and voltage regions within the range used in this example, since the current-luminance characteristic of the organic EL element is approximately linear, the accumulated luminance ratio indicating the contrast and a total current-carrying amount ratio are approximately coincident with each other. Consequently, in what follows, the degree of the deterioration of the contrast in case of $t<1$ in regard to the contrast in case of $t=1$ will be described by using the ratio between the total current-carrying amount to the organic EL element at the maximum gradation displaying time and the total current-carrying amount to the organic EL element at the minimum gradation displaying time. Moreover, in the driving sequence illustrated in FIG. 2B, since the program period (B) is sufficiently shorter than the emission period (C) and the non emission period (D), the program period will be disregarded in the following argument.

When the total current-carrying amounts to the organic EL element in the one frame period at the maximum gradation displaying time and the minimum gradation displaying time are respectively represented by $S_{wh}$ and $S_{bk}$, $S_{wh}$ and $S_{bk}$ are respectively represented by the following expressions (5) and (6).

$$S_{wh}=I_{wh}\times t+I_{leak}\times(1-t) \tag{5}$$

$$S_{bk}=I_{bk}\times t+I_{bk_}\text{off}\times(1-t) \tag{6}$$

It should be noted that the definitions of $I_{wh}$, $I_{bk}$, $I_{leak}$, $I_{bk_}$off have been described as above.

Here, the organic EL displaying apparatus having $I_{wh}$ of $5\times10^{-7}$ A and $I_{bk}$ of $5\times10^{-12}$ A, manufactured in Example 1, is considered. The contrast in case of t=1 in this apparatus is $S_{wh}/S_{bk}=I_{wh}/I_{bk}=100000$, from the above expressions (5) and (6).

On the other hand, the approximate values of the contrasts in a case where the values of $I_{leak}$ and t are changed are represented by Table 1 below. Here, $I_{leak}$ and the resistance $R_{off_}$ILM between the source electrode and the drain electrode at the time when the emission period controlling transistor 163 is off satisfy the relation of the following expression (7).

$$V_{cc}-V_{ocom}=(R_{wh_}Dr+R_{off_}ILM+R_{el})\times I_{leak} \tag{7}$$

It should be noted that the expression (7) is the relational expression of the voltage drop on the wiring route between the power supply line and the grounding line in the pixel circuit in the non emission period at the maximum gradation displaying time in the state (4) of FIG. 4. Here, $V_{cc}$ indicates the power supply line potential, $V_{ocom}$ indicates the grounding line potential, $R_{wh_}$Dr indicates the resistance between the source and drain electrodes of the driving transistor 162 in the state (4) of FIG. 4, and $R_{el}$ indicates the resistance of the organic EL element 17 in the state (4) of FIG. 4. Moreover, the value of $I_{leak}$ in Table 1 is the current value in the case where the expression (2) is satisfied and $I_{leak}$ is equal to or smaller than $I_{bk}=5\times10^{-12}$ A.

TABLE 1

| $I_{leak}$ [A] | t = 1 | t = 0.7 | t = 0.5 | t = 0.25 | t = 0.05 |
|---|---|---|---|---|---|
| $5\times10^{-14}$ | 100000 | 99600 | 99000 | 97100 | 84200 |
| $1\times10^{-13}$ | 100000 | 99200 | 98100 | 94400 | 72900 |
| $5\times10^{-13}$ | 100000 | 96300 | 91700 | 78600 | 36700 |
| $1\times10^{-12}$ | 100000 | 93300 | 85700 | 66700 | 24000 |
| $5\times10^{-12}$ | 100000 | 82400 | 66700 | 40000 | 9530 |

In $t<1$, even if $I_{leak}$ has any value, the contrast deteriorates due to the superposition of the leak current at the non emission time, as compared with $t=1$. However, in consideration of human sensitivity (visibility), it is desirable to have the contrast equal to or higher than 70% of the contrast in $t=1$. Therefore, it can be understood from Table 1 that it is desirably for $I_{leak}$ to have a value equal to or lower than $1\times10^{-12}$ A in $t=0.5$, have a value equal to or lower than $5\times10^{-13}$ A in $t=0.25$, and have a value equal to or lower than $1\times10^{-13}$ A in $t=0.05$. In $t=0.7$, it is possible for the organic EL displaying apparatus satisfying the above expression (2) to secure the contrast equal to or higher than 70%. This can be expressed by the following expression (8). Namely, when the organic EL displaying apparatus in the first embodiment is set to have the constitution that the high-luminance displaying mode and the low-luminance displaying mode can be switched over by a user according to a kind of image data, it is desirable that the value of $I_{leak}$ satisfies the relation of the following expression (8), in regard to the proportion t ($0<t\leq 1$) of the emission period in the one frame period.

$$\{I_{wh}\times t+I_{leak}\times(1-t)\}/\{I_{bk}\times t+I_{bk_}\text{off}\times(1-t)\}=S_{wh}/S_{bk}\geq 0.7\times I_{wh}/I_{bk}$$

In this way, even when the low-luminance display is performed by shortening the emission period in the organic EL displaying apparatus in the first embodiment, it is possible to achieve the high-contrast and satisfactory display. Thus, it is more preferable. Incidentally, $S_{wh}$ and $S_{bk}$ can be measured for the one frame period by using the current measuring method described in Example 1 or Modification of Example 1. Also, $I_{wh}$, $I_{leak}$, $I_{bk}$ and $I_{bk_}$off in the expression (8) can be measured by using the current measuring method described in Example 1 or Modification of Example 1.

Second Embodiment

Figure 8:
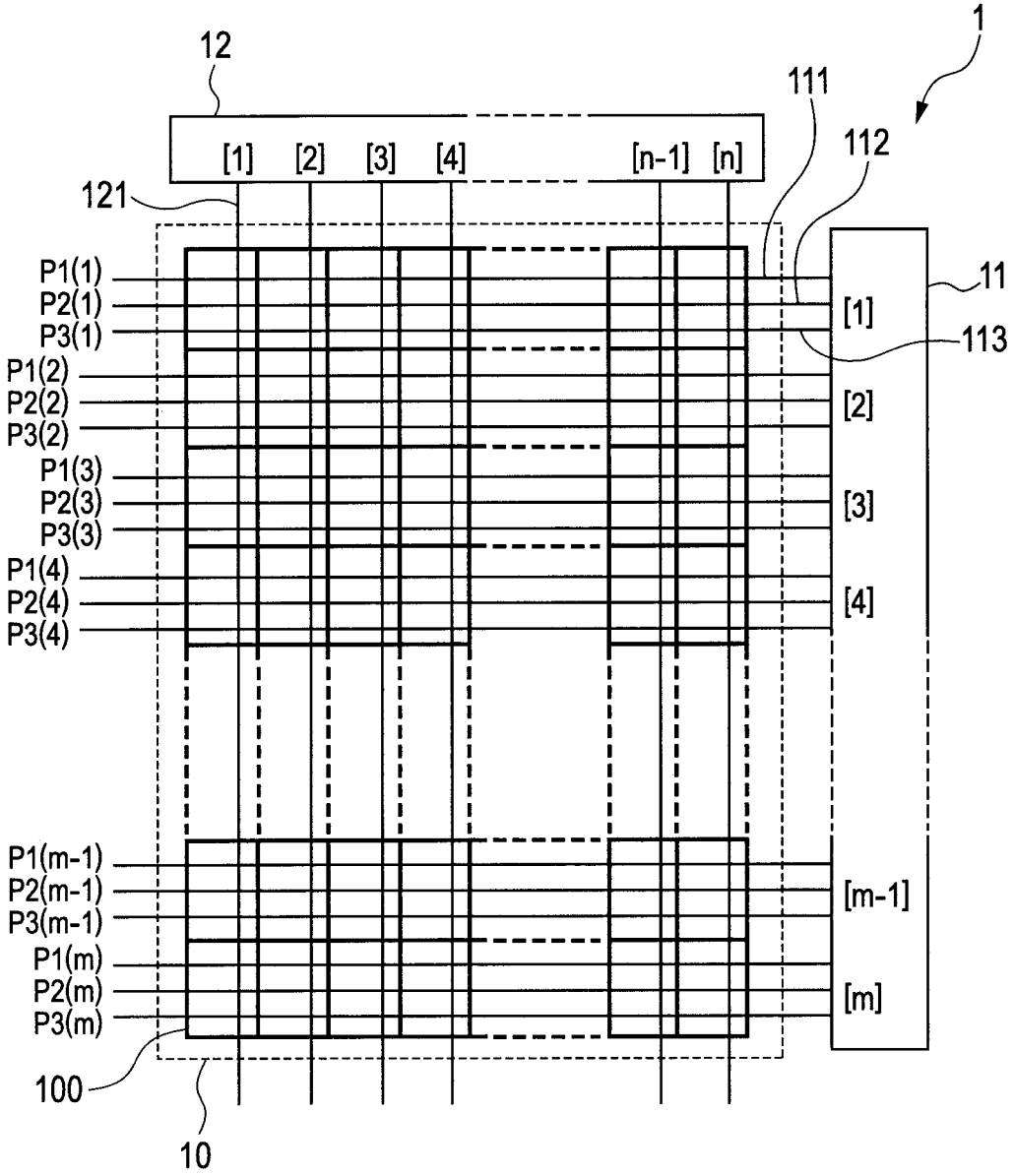
FIG. 8 is a diagram illustrating a constitution of an organic EL displaying apparatus according to a second embodiment.

FIG. 8 is a diagram illustrating a constitution of an organic EL displaying apparatus 1 according to the second embodiment. Here, since the pixel configuration and the driving sequence in the present embodiment are different from those in the first embodiment, the constitutions of a row controlling circuit 11 and a column controlling circuit 12 in the present embodiment are thus different from those in the first embodiment. However, the cross-section constitution of the displaying region in the present embodiment is the same as that in the first embodiment.

Initially, the constitution of the organic EL displaying apparatus and the driving sequence will be described. Here, in the organic EL displaying apparatus of the present embodiment, the parts same as or corresponding to those in the organic EL displaying apparatus of the first embodiment illustrated in FIG. 1 are indicated by the same or corresponding numerals and symbols respectively. Moreover, when the operations of these parts are the same as those of the parts in the first embodiment, the description thereof may be omitted in the present embodiment. Also, the organic EL displaying apparatus 1 of the present embodiment has a displaying region 10 in which a plurality of pixels 100 are two-dimensionally arranged in the form of m rows×n columns (m, n are natural numbers), and each of the pixels 100 is a red pixel, a blue pixel or a green pixel.

A plurality of control signals P1(1) to P1(*m*), P2(1) to P2(*m*), and P3(1) to P3(*m*) for controlling the operations of the pixel circuits are output from the respective output terminals of the row controlling circuit 11. Here, the control signal P1 is input to the pixel circuit of each row through a control line 111, the control signal P2 is input to the pixel circuit of each row through a control line 112, and the control signal P3 is input to the pixel circuit of each row through a control line 113. In FIG. 8, the three control lines are connected to each output terminal of the row controlling circuit 11. However, the number of the control lines is not limited to three. Namely, two or less control lines, or four or more control lines may be used according to a constitution of the pixel circuit.

A video signal is input from the driver IC or the like (not illustrated) to the column controlling circuit 12, and a data voltage $V_{data}$ being the gradation displaying data (data signal) according to the video signal is output from each output terminal of the column controlling circuit. Moreover, a reference voltage $V_{sl}$ is output from each output terminal. The data voltage $V_{data}$ and the reference voltage $V_{sl}$ output from the output terminal of the column controlling circuit 12 are input to the pixel circuit of each column through a data line 121. Here, the data line 121 for supplying the data voltage may be provided separately from a reference voltage line for supplying the reference voltage, and the wiring connections of these lines may be switched over.

Figure 9A:
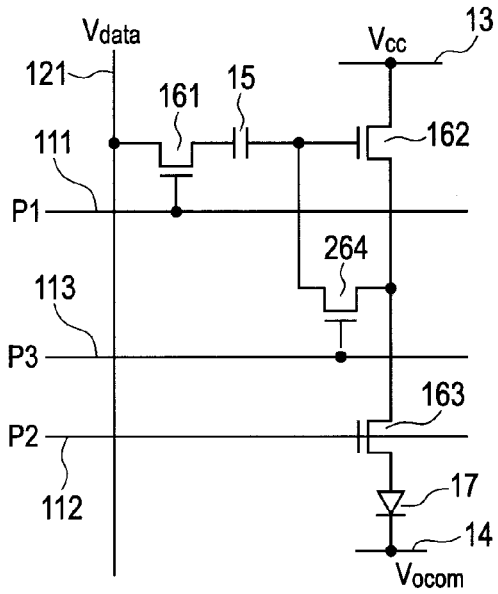
FIGS. 9A and 9B are diagrams indicating a constitution of a pixel circuit of the organic EL displaying apparatus and its driving method, according to the second embodiment.
Figure 9B:
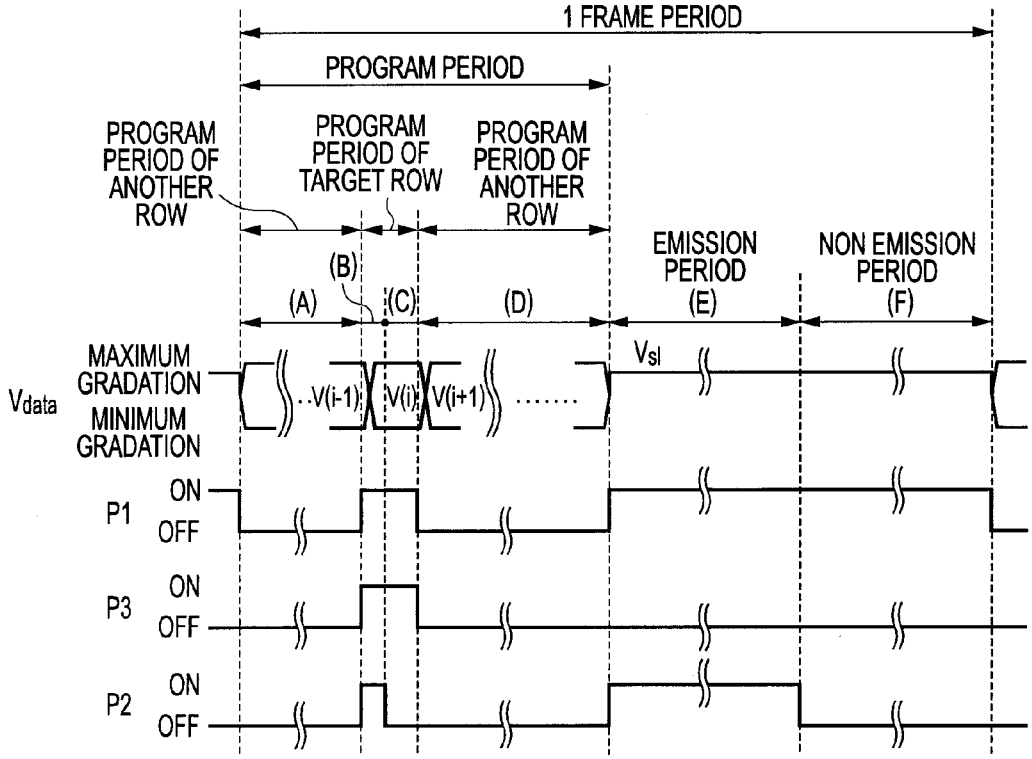

FIG. 9A is a diagram illustrating an example of the pixel circuit illustrated in FIG. 8, and FIG. 9B is a timing chart indicating an example of the driving sequence of the pixel circuit illustrated in FIG. 9A.

The pixel circuit illustrated in FIG. 9A is constituted by a selecting transistor 161 acting as a switching transistor, a driving transistor 162, an emission period controlling transistor 163, an erasing transistor 264, a storage capacitor 15, and an organic EL element 17.

Here, each of the selecting transistor 161, the emission period controlling transistor 163 and the erasing transistor 264 is an N-type transistor, and the driving transistor 162 is a P-type transistor. The selecting transistor 161 is disposed so that its gate electrode is connected to the control line 111, its drain electrode is connected to the data line 121, and its source electrode is connected to the storage capacitor 15. The erasing transistor 264 is disposed so that its gate electrode is connected to the control line 113, one of its source and drain electrodes is connected to the gate electrode of the driving transistor 162, and the other of its source and drain electrodes is connected to the drain electrode of the driving transistor 162 and the drain electrode of the emission period controlling transistor 163. The driving transistor 162 is disposed so that its source electrode is connected to a power supply line 13, and its drain electrode is connected to one of the source and drain electrodes of the erasing transistor 264 and the drain electrode of the emission period controlling transistor 163. The emission period controlling transistor 163 is disposed so that its gate electrode is connected to the control line 112, and its source electrode is connected to the anode of the organic EL element 17. The cathode of the organic EL element 17 is connected to a grounding line 14. The storage capacitor 15 is disposed among the selecting transistor 161, the gate electrode of the driving transistor 162, and one of the source and drain electrodes of the erasing transistor 264.

It is preferable to provide the storage capacitor 15 as in the present embodiment, for the reason that it is possible to maintain the potential of the gate electrode of the driving transistor 162. Further, it is preferable to provide the control line 111 and the selecting transistor 161 as in the present embodiment, for the reason that it is possible to control the supplying of the data voltage by the control line 111 and the selecting transistor 161. Furthermore, it is preferable to provide the control line 113 and the erasing transistor 264 as in the present embodiment, for the reason that it is possible to reduce an adverse effect of variation of a threshold voltage of the driving transistor on the displaying characteristic by the control line 113 and the erasing transistor 264.

Each of the driving transistor 162, the emission period controlling transistor 163 and the erasing transistor 264 may be a P-type transistor.

In the timing chart illustrated in FIG. 9B, a one frame period is divided into three periods, i.e., a program period (periods (A) to (D)), an emission period (period (E)) and a non emission period (period (F)). Here, the program period in FIG. 9B is the period in which all the rows are programmed. More specifically, the program period includes a program period of a target row (target-row program period) in which the gradation displaying data is written into the pixel of the target row (periods (B) and (C)) and a program period of another row (another-row program period) in which the gradation displaying data is written into the pixel of the row other than the target row (periods (A) and (D)).

After the pixels of all the rows were programmed in the program period, the pixels of all the rows simultaneously emit light in the emission period, and simultaneously black out in the non emission period. Here, the emission period is the period in which the organic EL elements of the pixels of all the rows including the pixel of the target row emit light, and the non emission period is the period in which the organic EL elements of the pixels of all the rows including the pixel of the target row are controlled not to emit light. The emission period and the non emission period are defined by on and off states of the emission period controlling transistor. Incidentally, a ratio of the emission period and the non emission period subsequent to the program period in the one frame period may arbitrarily be set. In the drawing, symbols V(i−1), V(i) and V(i+1) indicate the data voltages $V_{data}$ to be input respectively to the pixel circuits at the (i−1)-th row (one-prior row of target row), the i-th row (target row) and the (i+1)-th row (one-posterior row of target row) in the one frame period, on the target column.

(A) Another-Row Program Period (Prior to Target Row)

In this period, a low-level signal is input to each of the control lines 111 and 113 in the pixel circuit at the target row, whereby each of the selecting transistor 161 and the erasing transistor 264 is set to an off state. Consequently, the data voltage V(i−1) being the gradation displaying data at the one-prior row is not input to the pixel circuit at the i-th row being the target row. During this period, in the pixel at the target row, the gradation displaying data programmed in the immediately previous frame period is held in the storage capacitor 15 until the program period of the target row starts. At this time, the off state of the emission period controlling transistor 163 is maintained.

(B) Discharge Period

In this period, a high-level signal is input to each of the control lines 111 to 113 in the pixel circuit at the target row, whereby each of the selecting transistor 161, the erasing transistor 264 and the emission period controlling transistor 163 is set to an on state. Consequently, the data voltage V(i) being the gradation displaying data of the target row is set to the data line 121, and the data voltage V(i) is input to the side of the data line 121 of the storage capacitor 15. Moreover, each of the erasing transistor 264 and the emission period controlling transistor 163 comes to an on state. Thus, the gate electrode of the driving transistor 162 and the grounding line 14 are connected to each other through the organic EL element 17. Consequently, the potential of the gate electrode of the driving transistor 162 comes to have a potential close to grounding line potential $V_{ocom}$ irrespective of the potential in the immediately preceding state, and the driving transistor 162 comes to an on state.

(C) Program Period

In this period, a low-level signal is input to the control line 112, whereby the emission period controlling transistor 163 is set to an off state. Consequently, a current flows from the drain electrode to the gate electrode in the driving transistor 162, whereby the gate-source voltage of the driving transistor 162 comes close to a threshold voltage of the driving transistor 162. The gate voltage of the driving transistor 162 at this time is input to the side of the storage capacitor 15 which is connected to the gate electrode of the driving transistor. Moreover, the data voltage V(i) being the gradation displaying data of the corresponding row is still set to the data line 121 from the period (B), and the data voltage V(i) is input to the side of the data line 121 of the storage capacitor 15. Consequently, an electric charge corresponding to a voltage of a difference between the gate voltage of the driving transistor 162 and the data voltage V(i) is charged to the storage capacitor 15, whereby the gradation displaying data voltage is programmed.

(D) Another-Row Program Period (Posterior Row of Target Row)

In this period, a low-level signal is input to each of the control lines 111 and 113, whereby each of the selecting transistor 161 and the erasing transistor 264 is set to an off state. Consequently, even when the voltage of the data line 121 changes to the data voltage V(i+1) being the gradation displaying data concerning the posterior row, the electric charge charged to the storage capacitor 15 in the period (C) is held. The pixel of the target row is on standby with this state until the program of another row is completed. At this time, the off state of the emission period controlling transistor 163 is maintained.

(E) Emission Period

In this period, a high-level signal is input to the control lines 111 of all the rows, whereby the selecting transistors 161 included in the pixel circuits of all the rows are set to an on state. Then, a reference voltage $V_{sl}$ is set to the data lines of all the columns. Consequently, the reference voltage $V_{sl}$ is input to the side of the data line 121 of the storage capacitor 15. Since the erasing transistor 264 is in an off state in this period, the electric charge charged to the storage capacitor 15 in the period (C) is held. Therefore, the gate voltage of the driving transistor 162 changes by a difference between the data voltage V(i) and the reference voltage $V_{sl}$.

After then, a high-level signal is input to the control line 111 in the period (E) and the period (F), and a low-level signal is input to the control line 113 in the period (E) and the period (F). Consequently, the on state of the selecting transistor 161 and the off state of the erasing transistor 264 are maintained in the period (E) and the period (F), whereby the gate voltage of the driving transistor 162 is maintained constant during these periods.

Moreover, in this period, a high-level signal is input to the control line 112, whereby the emission period controlling transistor 163 is set to an on state. Consequently, a current according to the potential of the gate electrode of the driving transistor 162 is supplied to the organic EL element 17, whereby the organic EL element 17 emits light with the gradation luminance according to the supplied current.

(F) Non Emission Period

In this period, a low-level signal is input to the control lines 112 of all the rows, whereby the emission period controlling transistor 163 is set to an off state. Consequently, the organic EL element 17 does not emit light in this period.

As just described, in the driving sequence of the organic EL displaying apparatus 1 of the present embodiment, the on state and the off state of the emission period controlling transistor 163 are controlled in response to the control signal P2 of the control line 112, whereby the emission period of the organic EL element 17 is controlled.

In the present embodiment, to suppress that a luminance variation occurs due to the current $I_{leak}$ in the non emission period, the emission period controlling transistor 163 and the driving transistor 162 are constituted so that the resistances of them satisfy the expression (1) and the currents values $I_{leak}$ and $I_{bk}$ satisfy the expression (2) in the above driving sequence. Here, the respective definitions of the resistance $R_{off}$_ILM of the emission period controlling transistor 163, the resistance $R_{bk}$_Dr of the driving transistor 162, and the currents values $I_{leak}$ and $I_{bk}$ are the same as those in the first embodiment. That is, the resistance $R_{off}$_ILM is the resistance between the source electrode and the drain electrode of the emission period controlling transistor 163 at the time when the emission period controlling transistor 163 is off. The resistance $R_{bk}$_Dr is the resistance between the source electrode and the drain electrode of the driving transistor 162 in the emission period in the state that the minimum gradation displaying data voltage is applied to the gate electrode of the driving transistor 162. The current value $I_{leak}$ is the value of the current flowing in the organic EL element 17 in the non emission period in the state that the maximum gradation displaying data voltage is applied to the gate electrode of the driving transistor 162. The current value $I_{bk}$ is the value of the current flowing in the organic EL element 17 in the emission period in the state that the minimum gradation displaying data voltage is applied to the gate electrode of the driving transistor 162. In this way, even when the driving for controlling the emission period is performed by the organic EL displaying apparatus in the present embodiment, the emission luminance of the organic EL element by the leak current at the time when the emission period controlling transistor 163 is off in the non emission period is not larger than the minimum gradation luminance in the emission period, whereby it is possible to suppress that the luminance variation occurs.

Hereinafter, a comparative example of the present embodiment will be described. Here, this comparative example is equivalent to a case where, in the same constitution as that of the organic EL displaying apparatus in the present embodiment, there are one or a plurality of pixels not satisfying the above expressions (1) and (2) due to different sizes or the like of the emission period controlling transistor 163.

Figure 10:
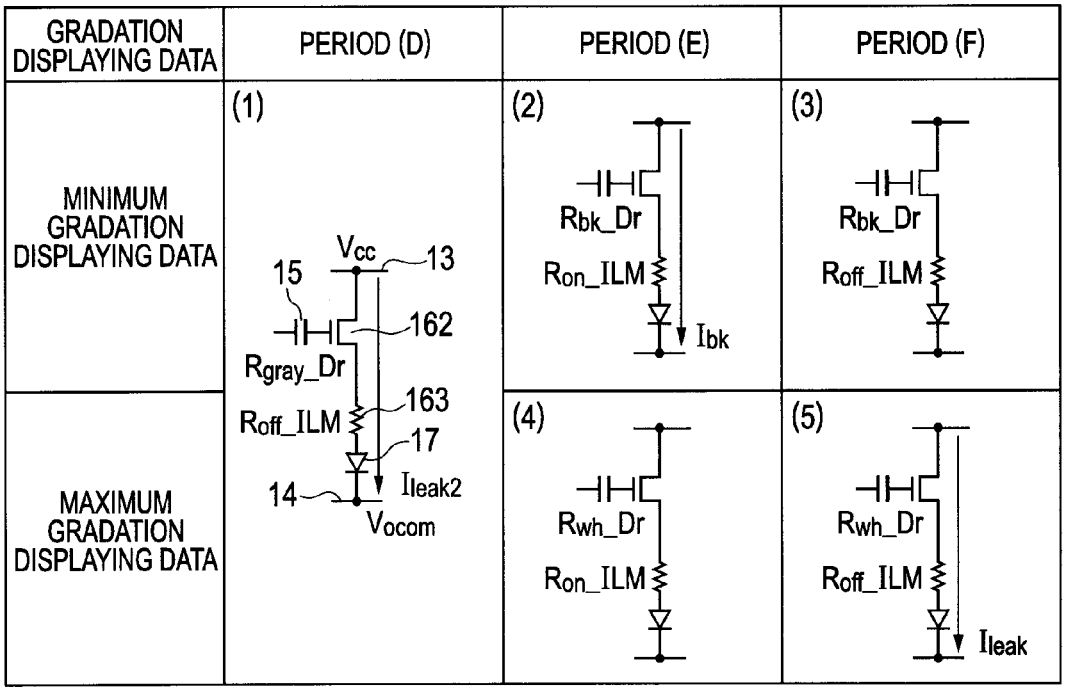
FIG. 10 is a diagram indicating a driving state of the pixel circuit illustrated in FIG. 9A.

In the pixel in which the resistances of the emission period controlling transistor 163 and the driving transistor 162 and the current values $I_{leak}$ and $I_{bk}$ do not satisfy the expressions (1) and (2), it can be said that the emission luminance (leak luminance) of the organic EL element by the leak current in the non emission period (F) is larger than the minimum gradation luminance in the emission period of the period (E). Further, the emission luminance (leak luminance) of the organic EL element by the leak current in the period (D) in the program period is sometimes larger than the minimum gradation luminance in the emission period of the period (E). More specifically, when the combined resistance of the resistances $R_{gray}$_Dr and $R_{off}$_mM in a later-described state (1) of FIG. 10 is smaller than the combined resistance of the resistances $R_{bk}$_Dr and $R_{on}$_ILM in a later-described state (2) of FIG. 10, the emission luminance (leak luminance) of the organic EL element by the leak current in the period (D) is larger than the minimum gradation luminance in the emission period of the period (E). Furthermore, it can be said that, in the period (A) of the program period, when the data voltage programmed in the immediately preceding frame period is equal to or higher than a certain gradation, the emission luminance (leak luminance) of the organic EL element by the leak current in the period (A) is larger than the minimum gradation luminance in the emission period of the period (E). In the driving for the emission period control, the gradation display is performed based on the emission luminance of the organic EL element in the emission period. Thus, in the pixel in which the leak luminance is larger than the minimum gradation luminance, the emitted light, at the leak luminance larger than the minimum gradation luminance, of the organic EL element in the non emission period, the period (A) or the period (D) is superposed to the emitted light in the emission period. For this reason, the gradation display cannot be correctly performed in the relevant pixel, whereby the luminance variation occurs.

Moreover, in the organic EL displaying apparatus in the comparative example of the present embodiment, there is a case where a problem of contrast deterioration due to occurrence of following black floating in addition to the luminance variation occurs. This problem will be described with reference to FIG. 10.

FIG. 10 is the diagram indicating the states of the pixel circuit illustrated in FIG. 9A in the periods (D), (E) and (F) illustrated in FIG. 9B. In FIG. 10, the selecting transistor 161 and the data line 121 are omitted, and the emission period controlling transistor 163 is illustrated as the resistor.

More specifically, (1) of FIG. 10 shows the pixel circuit in the period (D). Further, (2) of FIG. 10 shows the pixel circuit in the period (E) and (3) of FIG. 10 shows the pixel circuit in the period (F), in the case where the minimum gradation displaying data voltage is applied to the gate electrode of the driving transistor 162. Further, (4) of FIG. 10 shows the pixel circuit in the period (E) and (5) of FIG. 10 shows the pixel circuit in the period (F), in the case where the maximum gradation displaying data voltage is applied to the gate electrode of the driving transistor 162.

Since the selecting transistor 161 and the erasing transistor 264 are in an off state in the period (D) in the driving sequence, the electric charge charged to the storage capacitor 15 in the period (C) is held. Since this is the electric charge corresponding to the gate voltage of the driving transistor 162 at the time when the gate-source voltage of the driving transistor 162 comes close to the threshold voltage of the driving transistor 162 in the period (C), the driving transistor 162 does not come to be completely in the off state in the period (D) irrespective of the gradation displaying data voltage set to the data line 121 in the program period (C). Namely, the driving transistor is in an intermediate state between the on state and the off state.

Resistance between the source and drain electrodes of the driving transistor 162 in this state is represented by $R_{gray}$_Dr. In the state (1) of FIG. 10, a current $I_{leak2}$ corresponding to a voltage between power supply line potential $V_{cc}$ and grounding line potential $V_{ocom}$, resistances $R_{gray}$_Dr and $R_{off}$_ILM, and a voltage drop on the wiring route between the power supply line 13 and the grounding line 14 except for the driving transistor 162 and the emission period controlling transistor 163 flows in the organic EL element. Therefore, the organic EL element emits light with luminance according to the current $I_{leak2}$.

In the organic EL displaying apparatus 1 of the present embodiment, since it is constructed that the resistances of the emission period controlling transistor 163 and the driving transistor 162 satisfy the expression (1), it is possible to control the emission luminance of the organic EL element to be equal to or smaller than the minimum gradation luminance even in the state (1) of FIG. 10. Since the resistance $R_{gray}$_Dr of the driving transistor 162 in the intermediate state is smaller than the resistance $R_{bk}$_Dr in the state that the minimum gradation displaying data voltage is applied to the gate electrode of the driving transistor 162, the current $I_{leak2}$ does not come to be larger than the current $I_{bk}$ flowing in the organic EL element in the state (2) of FIG. 10, in the organic EL displaying apparatus 1 of the present embodiment satisfying the expression (1). For this reason, it is possible to control the emission luminance of the organic EL element by the leak current at the time when the emission period controlling transistor 163 in the period (D) is off to be equal to or smaller than the minimum gradation luminance of the organic EL element in the period (E). Therefore, when the minimum gradation displaying data is programmed to the gate electrode of the driving transistor 162 in the period (C), the emitted light at the luminance larger than the minimum gradation luminance is not superposed in the period (D), whereby it is possible to suppress the luminance variation at the time of the minimum gradation display.

On the other hand, in the organic EL displaying apparatus of the comparative example in the present embodiment, the pixel in which the resistances of the emission period controlling transistor 163 and the driving transistor 162 do not satisfy the expression (1) is present, and there is a case where the current $I_{leak2}$ comes to be larger than the current $I_{bk}$ in this pixel. More specifically, when the combined resistance of the resistances $R_{gray}$_Dr and $R_{off}$_ILM in the state (1) of FIG. 10 is smaller than the combined resistance of the resistances $R_{bk}$_Dr and $R_{on}$_ILM in the state (2) of FIG. 10, the current value $I_{leak2}$ is larger than the current $I_{bk}$. In this case, in the program period of the period (D), the light emission at the luminance larger than the minimum gradation luminance in the emission period of the period (E) occurs. Consequently, in this pixel, when the minimum gradation displaying data voltage is programmed to the gate electrode of the driving transistor 162 in the period (C), the emitted light at the luminance larger than the minimum gradation luminance in the period (D) is superposed to the emitted light at the minimum gradation luminance in the period (E), whereby the contrast deteriorates since the luminance variation at the time of the minimum gradation display occurs.

Incidentally, to evaluate whether or not the displaying apparatus according to the second embodiment has been manufactured, there are following ways. Namely, in case of evaluating the current flowing in the organic EL element for each pixel, it only has to measure the current values $I_{leak}$ and $I_{bk}$ by using the current measuring method described in Example 1. Further, in the displaying apparatus according to the second embodiment, the pixels of all the rows concurrently emit light in the emission period, and concurrently stop emitting light in the non emission period. In the displaying apparatus of performing the driving operation like this, it only has to measure the sum total of the current values $I_{leak}$ and the sum total of the current values $I_{bk}$ respectively flowing in the organic EL elements of the pixels included in all the rows in the displaying region, by using the current measuring method described in Modification of Example 1.

Third Embodiment

Figure 11:
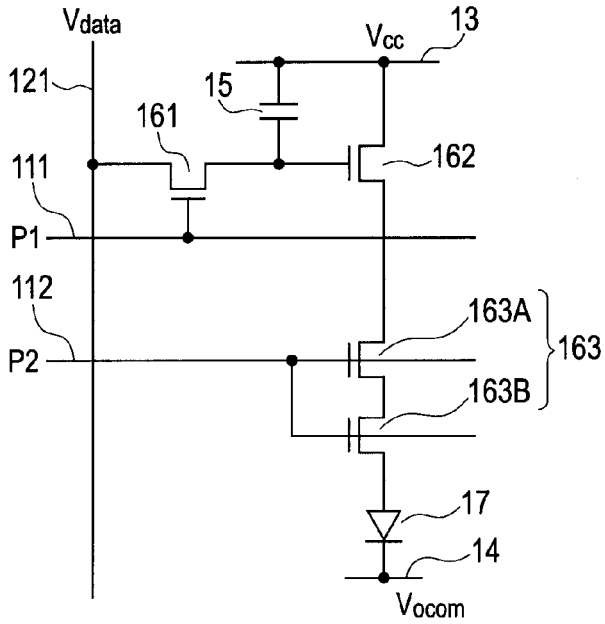
FIG. 11 is a diagram illustrating a constitution of an organic EL displaying apparatus according to a third embodiment.

In the first embodiment, the organic EL displaying apparatus in which the emission period controlling transistor is constituted by the single transistor has been described. In the present embodiment, the organic EL displaying apparatus has the emission period controlling transistor in which the two transistors are connected in series by means of their source or drain electrodes, and the common control line is provided to the gate electrodes of these two transistors. FIG. 11 illustrates the pixel circuit according to the present embodiment. Incidentally, the constitution of the organic EL displaying apparatus in the present embodiment is the same as that of the organic EL displaying apparatus 1 in the first embodiment except for the constitution of the emission period controlling transistor, and also the driving sequence or the like in the present embodiment is the same as that in the first embodiment.

In the organic EL displaying apparatus of the present embodiment, an off resistance $R_{off}$_ILM of an emission period controlling transistor 163 is the combined resistance of the resistances between the source and drain electrodes of a plurality of transistors 163A and 163B constituting the emission period controlling transistor 163 at a time when these transistors are off. Therefore, the combined resistance $R_{off}$_ILM of the off resistances of the two transistors is set to satisfy the expression (1), and current values $I_{leak}$ and $I_{bk}$ are set to satisfy the expression (2). Here, the respective definitions of the currents values $I_{leak}$ and $I_{bk}$ are the same as those in the first embodiment.

In the present embodiment, since the emission period controlling transistor 163 is constituted by the plurality of transistors 163A and 163B, it is possible to have the following effect.

Generally, there is a case where an off resistance of a transistor becomes small due to influence of static electricity occurred in a manufacturing process of the transistor, carrier transportation occurred through a level of crystal grain boundary when an edge of the gate electrode and the crystal grain boundary of the active layer are coincident, or the like. When the emission period controlling transistor 163 is constituted by a single transistor, there is a case where a defective pixel is generated due to such adverse effects. On the other hand, when the emission period controlling transistor 163 is constituted by the plurality of transistors as in the present embodiment, even if the off resistance of one transistor becomes small due to the above adverse effects, the combined resistance of the off resistances of the one transistor and the other transistor may satisfy the expression (1). Therefore, it is possible to more definitely achieve the organic EL displaying apparatus which satisfies the expression (1). Consequently, the current values $I_{leak}$ and $I_{bk}$ satisfy the expression (2), and it is thus possible to suppress occurrence of a luminance variation.

The emission period controlling transistor 163 may be constituted to have three or more transistors mutually connected in series and a control line common to these transistors. As the number of the transistors, connected in series, of constituting the emission period controlling transistor 163 increases, it is possible to further improve the effect of suppressing the occurrence of the luminance variation.

Example 3

A concrete example of the organic EL displaying apparatus 1 according to Example 3 will be described hereinafter.

In this example, in the pixel circuit illustrated in FIG. 11, the selecting transistor 161 is an N-type transistor, the driving transistor 162 is a P-type transistor, and the emission period controlling transistor 163 is an N-type transistor. Here, the driving transistor 162 was set to have its channel length of 24 μm and its channel width of 10 μm, and the emission period controlling transistor was set to have the two N-type transistors 163A and 163B each having its channel length of 4 μm and its channel width of 2.5 μm and being connected in series by means of the respective source or drain electrodes. Further, the common control line 112 connected to the respective gate electrodes of the two transistors was set, and the 100 organic EL displaying apparatuses having the above constitutions were manufactured. The manufactured organic EL displaying apparatus is the same as the organic EL displaying apparatus 1 in Example 1 except for the constitution concerning the emission period controlling transistor 163. Moreover, the organic EL displaying apparatus was manufactured in the manufacturing process same as that in Example 1.

In the manufactured organic EL displaying apparatus, the proportion t ($0<t\leq1$) of the emission period in the periods other than the program period in the one frame period was set to 0.7, a voltage of 9.5V was applied as the power supply line voltage (i.e., the voltage between the power supply line potential $V_{cc}$ and the grounding line potential $V_{ocom}$), and one gradation displaying data on the low gradation side in the intermediate gradation displaying data was programmed to all the pixels and driven in the driving sequence illustrated in FIG. 2B. Here, the intermediate gradation displaying data is the remaining gradation displaying data other than the minimum gradation displaying data and the maximum gradation displaying data in all the gradation displaying data.

In the driving, the number of the manufactured organic EL displaying apparatuses including the defective pixels having the luminance higher than the peripheral pixels and thus being viewed, and having the luminance equal to or higher than 1.2 $L_{mean}$ of average luminance $L_{mean}$ in the displaying region was zero. Subsequently, the arbitrary ten organic EL displaying apparatuses were selected from the 100 organic EL displaying apparatuses, and the selected apparatuses were driven according to the driving sequence condition illustrated in FIG. 2B as well as Example 1. Then, in regard to one of the arbitrarily selected ten organic EL displaying apparatuses, the current value flowing in the organic EL element 17 included in a red pixel 100*a* (R) arbitrarily selected from the plurality of pixels 100 was evaluated by the method described in Example 1. When the current $I_{bk}$ flowing in the organic EL element 17 of the pixel 100*a* (R) in the period (C) was measured, the current value of $5\times10^{-12}$ A was obtained. Moreover, when the current $I_{leak}$ flowing in the organic EL element 17 of the pixel 100*a* (R) in the period (D) was measured, the current value of $1.8\times10^{-13}$ A was obtained, whereby the expression (2) was satisfied. When the current values flowing in the organic EL elements 17 of the plurality of other pixels 100 (R) were measured in the same manner, the relation of the expression (2) was satisfied for all the measured pixels.

Also, for each of the remaining nine organic EL displaying apparatuses in the arbitrarily selected ten organic EL displaying apparatuses, when the current values flowing in the organic EL elements 17 of the plurality of pixels 100 (R) in the displaying region were measured in the same manner, the relation of the expression (2) was satisfied for all the measured pixels in all the organic EL displaying apparatuses.

For the remaining 90 organic EL displaying apparatuses, when the sum total of the currents flowing in the organic EL elements included in the respective pixels was evaluated for each row in the method described in Modification of Example 1, the expression (2)' was satisfied for all the measured rows in all the organic EL displaying apparatuses.

In the organic EL displaying apparatus in this example, the expression (2) was satisfied for the pixel 100*a* (R). For this reason, in the pixel 100*a* (R), the emission luminance of the organic EL element 17 by the leak current at the off time of the emission period controlling transistor 163 in the non emission period is not larger than the minimum gradation luminance in the emission period even when the driving for controlling the emission period is performed. Therefore, since the same pixel circuit is formed not only for the pixel 100*a* (R) but also for other color pixels, it is possible to suppress the occurrence of the luminance variation for the pixels of all the colors. Moreover, since the expression (2)' was satisfied in the organic EL displaying apparatus in this example, it was possible to suppress the luminance variation of the average luminance for each row.

As a comparative example, the 100 organic EL displaying apparatuses each having the constitution of Example 1 that the emission period controlling transistor 163 was constituted by the single transistor were manufactured. In the manufactured organic EL displaying apparatus, the proportion t ($0<t\leq1$) of the emission period in the periods other than the program period in the one frame period was set to 0.7, a voltage of 9.5V was applied as the power supply line voltage (i.e., the voltage between the power supply line potential $V_{cc}$ and the grounding line potential $V_{ocom}$), and the intermediate gradation displaying data same as that in Example 3 was programmed to all the pixels and driven in the driving sequence illustrated in FIG. 2B. At the time of the driving, the 15 organic EL displaying apparatuses each having the one or two pixels having the higher luminance than that of the peripheral pixels and thus being visible in the displaying region were included.

With respect to the organic EL displaying apparatus including the pixel having the higher luminance than that of the peripheral pixels and thus being visible, when the current flowing in the organic EL element of the relevant pixel in the non emission period (D) was evaluated by the method described in Example 1 in the state that the maximum gradation displaying data voltage was applied to the gate electrode of the driving transistor, the current of $5.0\times10^{-10}$ A to $6.0\times10^{-9}$ A was obtained. When the luminance of the relevant pixel was measured by setting the measuring range of the luminance measuring unit to the relevant pixel, the luminance was equal to or higher than 1.2 $L_{mean}$ of the average luminance $L_{mean}$ in the displaying region. The relevant pixel is the defective pixel in which the off resistance of the transistor became small due to the influence of the static electricity occurred in the manufacturing process of the transistor, the carrier transportation occurred through the level of the crystal grain boundary when the edge of the gate electrode and the crystal grain boundary of the active layer are coincident, or the like.

With respect to the remaining 85 organic EL displaying apparatuses other than the 15 organic EL displaying apparatuses each including the defective pixel, when the sum total of the currents flowing in the organic EL element included in each pixel was evaluated for each row in the method described in Modification of Example 1, the expression (2)' was satisfied for all the measured rows in all the organic EL displaying apparatuses.

As just described, since the emission period controlling transistor is constituted by the plurality of transistors connected in series, the defectiveness caused in the transistor manufacturing process and the like can be reduced. Thus, it is possible to more definitely satisfy the above expression (1), i.e., the above expression (2) or the above expression (2)'.

In the present embodiment, the organic EL displaying apparatus 1 of the first embodiment has been modified by the constitution of the emission period controlling transistor in which the two transistors are connected in series by means of their source or drain electrodes and the common control line is provided to the gate electrodes of these two transistors. It should be noted that this constitution is also applicable to the second embodiment. That is, the organic EL displaying apparatus of the second embodiment may be modified by the constitution of the emission period controlling transistor in which two transistors are connected in series by means of their source or drain electrodes and a common control line is provided to the gate electrodes of these two transistors. Also in such a case, it is possible to have the effect same as that in the present embodiment.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-261242, filed Nov. 24, 2010 and Japanese Patent Application No. 2011-247715, filed Nov. 11, 2011, which are hereby incorporated by reference herein in their entirety.

What is claimed is:

1. An organic EL displaying apparatus comprising:

a plurality of pixels each of which includes an organic EL element, a driving transistor configured to supply a current according to potential of a gate electrode to the organic EL element, and an emission period controlling transistor connected in series to the organic EL element and the driving transistor and configured to control light emission of the organic EL element in response to a control signal, where, when the emission period controlling transistor is in an off state, a current is supplied to the organic EL element;

a data line configured to apply a data voltage according to gradation displaying data to the pixels; and a control line configured to supply the control signal to a gate electrode of the emission period controlling transistor, wherein, in a certain one of the pixels, a resistance $R_{off_}ILM$ between a source electrode and a drain electrode of the emission period controlling transistor in an off state of the emission period controlling transistor and a resistance $R_{bk_}Dr$ between a source electrode and a drain electrode of the driving transistor in a state that a minimum gradation displaying data voltage has been applied to the gate electrode of the driving transistor satisfy an expression (1) of $R_{off_}ILM \geq R_{bk_}Dr$, wherein when a driving voltage is applied to $R_{bk_}Dr$, a color to be displayed by the organic EL element is black, and wherein, if an emission state of the organic EL element when the driving voltage is applied to the driving transistor having the resistance $R_{bk_}Dr$ is a first black display and an emission state of the organic EL element when the driving voltage is applied to the emission period controlling transistor having the resistance $R_{off_}ILM$ is a second black display, emission luminance of the organic EL element in the second black display is equal to or smaller than the emission luminance of the organic EL element in the first black display.

2. The organic EL displaying apparatus according to claim 1, wherein in the emission period controlling transistor, a plurality of transistors are connected in series to others by means of their source electrodes or drain electrodes, and the control line connected to the respective gate electrodes of the plurality of transistors are common, and the combined resistance $R_{off_}ILM$ of the resistances between the source electrodes and the drain electrodes of the plurality of transistors in the off state of the plurality of transistors satisfies the expression (1).

3. An organic EL displaying apparatus comprising:

a plurality of pixels each of which includes an organic EL element, a driving transistor configured to supply a current according to potential of a gate electrode to the organic EL element, and an emission period controlling transistor connected in series to the organic EL element and the driving transistor and configured to control light emission of the organic EL element in response to a control signal;

a data line configured to apply a data voltage according to gradation displaying data to the pixels; and a control line configured to supply the control signal to a gate electrode of the emission period controlling transistor, wherein, in a certain one of the pixels, a current $I_{leak}$ which flows in the organic EL element in a case where a maximum gradation displaying data voltage is applied to the gate electrode of the driving transistor and the emission period controlling transistor is off, and a current $I_{bk}$ which flows in the organic EL element in a case where a minimum gradation displaying data voltage is applied to the gate electrode of the driving transistor and the emission period controlling transistor is on satisfy a relation $I_{bk} \geq L_{leak} \geq 0$, wherein when the current $I_{bk}$ flows in the organic EL element, a color to be displayed by the organic EL element is black, and wherein, if a state of the organic EL element when the current $I_{bk}$ flows in the organic EL element is a first black display and a state of the organic EL element when the current $I_{leak}$ flows in the organic EL element is a second black display, emission luminance of the organic EL element in the second black display is equal to or smaller than the emission luminance of the organic EL element in the first black display.

4. An organic EL displaying apparatus comprising:

a plurality of pixels each of which includes an organic EL element, a driving transistor configured to supply a current according to potential of a gate electrode to the organic EL element, and an emission period controlling transistor connected in series to the organic EL element and the driving transistor and configured to control light emission of the organic EL element in response to a control signal, and which are arranged in row and column directions;

a data line provided for each column of the plurality of pixels and configured to apply a data voltage according to gradation displaying data to the pixels; and a control line provided for each row of the plurality of pixels and configured to supply the control signal to a gate electrode of the emission period controlling transistor, wherein a first current $I_1$, which flows in the organic EL elements of the pixels in a first case where a minimum gradation displaying data voltage is applied to the gate electrodes of the driving transistors of the pixels included in at least one predetermined row and the emission period controlling transistors connected to the control lines included in the at least one predetermined row are on, is equal to or larger than a second current $I_2$, which flows in the organic EL elements of the pixels in a second case where a maximum gradation displaying data voltage is applied to the gate electrodes of the driving transistors of the pixels included in the at least one predetermined row and the emission period controlling transistors connected to the control lines included in the at least one predetermined row are off, and the gradation displaying data voltages applied to the gate electrodes of the driving transistors in the pixels in the rows other than the at least one predetermined row and on/off states of the emission period controlling transistors in the rows other than the at least one predetermined row are same as those in the first case, wherein when the first current $I_1$ flows in the organic EL displaying apparatus, a color to be displayed by the organic EL displaying apparatus is black, and wherein, if a state of the organic EL elements of the pixels in the first case when the first current $I_1$ flows in the organic EL elements of the pixels in the first case is a first black display and a state of the organic EL elements of the pixels in the second case when the second current $I_2$ flows in the organic EL elements of the pixels in the second case is a second black display, emission luminance of the organic EL elements of the pixels in the second case in the second black display is equal to or smaller than the emission luminance of the organic EL elements of the pixels in the first case in the first black display, and $I_2 > 0$.

5. An organic EL displaying apparatus comprising:

a plurality of pixels each of which includes an organic EL element, a driving transistor configured to supply a current according to potential of a gate electrode to the organic EL element, and an emission period controlling transistor connected in series to the organic EL element and the driving transistor and configured to control light emission of the organic EL element in response to a control signal, and which are arranged in row and column directions;

a data line provided for each column of the plurality of pixels and configured to apply a data voltage according to gradation displaying data to the pixels; and a control line provided for each row of the plurality of pixels and configured to supply the control signal to a gate electrode of the emission period controlling transistor, wherein the organic EL displaying apparatus has a function of switching over a plurality of displaying modes by changing an on time of the emission period controlling transistor, and in a certain one of the pixels, a current $I_{wh}$ which flows in the organic EL element in an emission period at a time of displaying a maximum gradation, an integrated amount $S_{wh}$ of the current which flows in the organic EL element in a one frame period at the time of displaying the maximum gradation, a current $I_{bk}$ which flows in the organic EL element in an emission period at a time of displaying a minimum gradation, and an integrated amount $S_{bk}$ of the current which flows in the organic EL element in a one frame period at the time of displaying the minimum gradation satisfy a relation of $S_{wh}/S_{bk} \geq 0.7 \times I_{wh}/I_{bk}$.

* * * * *